US006899530B2

(12) United States Patent
Lehrke et al.

(10) Patent No.: US 6,899,530 B2
(45) Date of Patent: May 31, 2005

(54) DIAPHRAGM PUMP WITH A TRANSFER CHAMBER VENT WITH A LONGITUDINAL NOTCH ON THE PISTON CYLINDER

(75) Inventors: Kenneth Eugene Lehrke, Maple Grove, MN (US); Richard D. Hembree, Bellingham, WA (US)

(73) Assignee: Wanner Engineering, Inc., Minneapolis, MN (US)

( * ) Notice: Subject to any disclaimer, the term of this patent is extended or adjusted under 35 U.S.C. 154(b) by 0 days.

(21) Appl. No.: 10/285,968

(22) Filed: Oct. 31, 2002

(65) Prior Publication Data

US 2004/0086398 A1 May 6, 2004

(51) Int. Cl.[7] ..... F04B 45/00
(52) U.S. Cl. ..... 417/395; 417/385; 417/386; 417/388
(58) Field of Search ..... 417/395, 385, 417/386, 388

(56) References Cited

U.S. PATENT DOCUMENTS 3,680,981 A * 8/1972 Wagner ..... 417/388
3,769,879 A * 11/1973 Lofquist, Jr. ..... 92/84
3,775,030 A 11/1973 Wanner
3,884,598 A 5/1975 Wanner
3,953,154 A 4/1976 Wanner
4,116,590 A 9/1978 Prestwich
4,749,342 A * 6/1988 Fritsch ..... 417/388
4,778,356 A * 10/1988 Hicks ..... 417/397
5,163,820 A 11/1992 Karliner
5,649,813 A * 7/1997 Able et al. ..... 417/387
5,667,368 A * 9/1997 Augustyn et al. ..... 417/385
5,707,219 A 1/1998 Powers
5,983,777 A 11/1999 Cassaday
6,071,089 A * 6/2000 Maier et al. ..... 417/386
6,468,056 B1 10/2002 Murakoshi
6,582,206 B2 * 6/2003 Schluecker ..... 417/395

* cited by examiner

*Primary Examiner*—Cheryl J. Tyler
*Assistant Examiner*—Emmanuel Sayoc
(74) *Attorney, Agent, or Firm*—Merchant & Gould P.C.

(57) ABSTRACT

A diaphragm pump which overcomes the problem of diaphragm failure due to overfill of the oil transfer chamber and the inability to self-prime. A notch is provided in the upper portion of the surface of the cylinder so that air can be forced back to the reservoir. In addition, the bias spring connected to the diaphragm and supported by the piston is made stiff with a spring constant that produces a bias pressure that can overcome abnormal suction pressures.

11 Claims, 16 Drawing Sheets

FIG.9A SUCTION STROKE
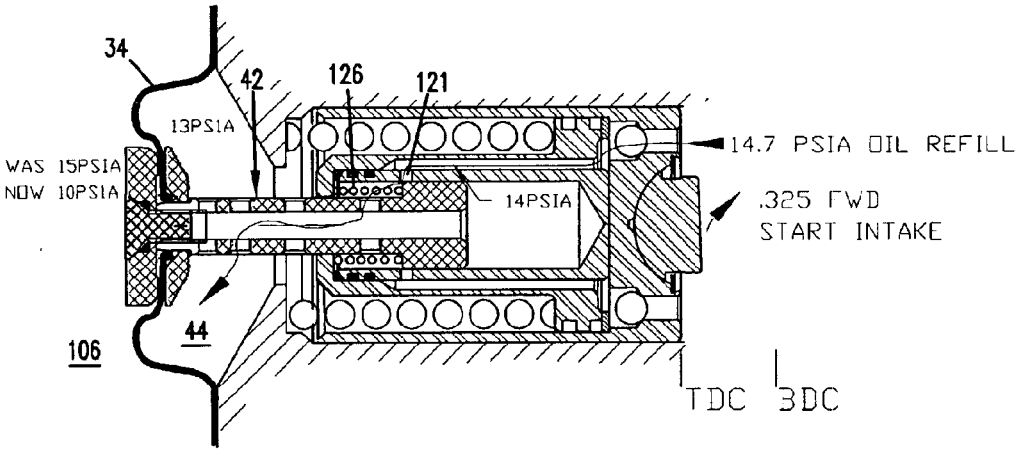
FIG.9B
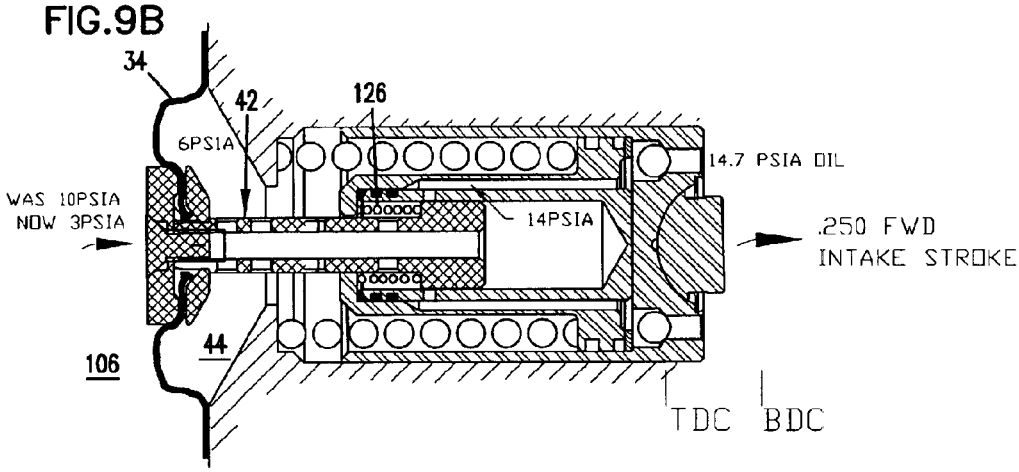
FIG.9C
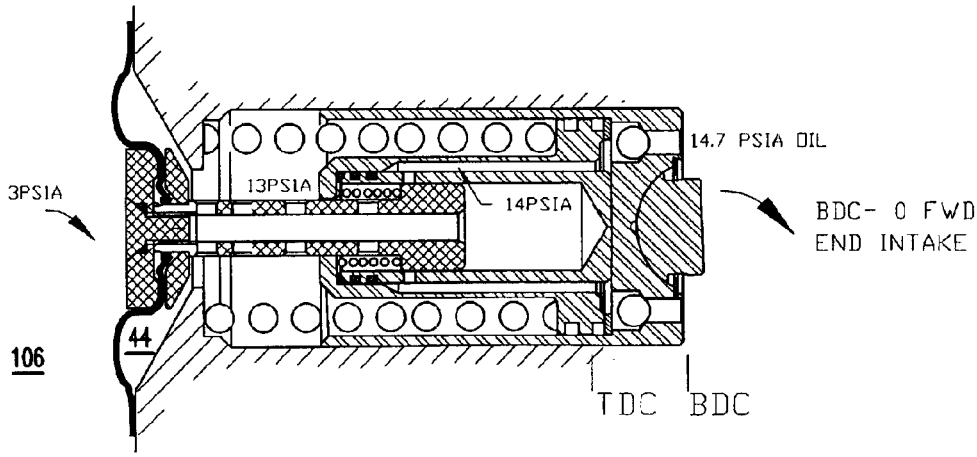

FORCES, LBS
18
16
14
12
10
8
6
4
2
0
SPRING LENGTH, INCHES
0
0.1
0.2
0.3
0.4
0.5
0.6
0.7
0.8
0.9
1
1.1
1.2
EFFECTIVE DIAPHRAM PSI AT PISTON EQUIV
15.0
13.5
12.0
10.5
9.0
7.5
6.0
4.5
3.0
1.5
0.0
140
142
144
146
148

DIAPHRAGM PUMP WITH A TRANSFER CHAMBER VENT WITH A LONGITUDINAL NOTCH ON THE PISTON CYLINDER

FIELD OF THE INVENTION

The present invention relates generally to an improved diaphragm pump, and more specifically, to an improved diaphragm pump for use under a condition where the hydraulic fluid side of the diaphragm is primed and the pumping side of the diaphragm is in a relatively high vacuum state and another condition where the hydraulic fluid side of the diaphragm is not primed.

DESCRIPTION OF THE ART

The known rotary-operated, oil-backed/driven diaphragm pump is a high-pressure pump inherently capable of pumping many difficult fluids because in the process fluid, it has no sliding pistons or seals to abrade. The diaphragm isolates the pump completely from the surrounding environment (the process fluid), thereby protecting the pump from contamination.

In general, a diaphragm pump 20 is shown in FIG. 1. Pump 20 has a drive shaft 22 rigidly held in the pump housing 24 by a large tapered roller bearing 26 at the rear of the shaft and a small bearing (not shown) at the front of the shaft. Sandwiched between another pair of large bearings (not shown) is a fixed-angle cam or wobble plate 28. As the drive shaft turns, the wobble plate moves, oscillating forward and back converting axial motion into linear motion. The three piston assemblies 30 (only one piston assembly is shown) are alternately displaced by the wobble plate 28. As shown later, each piston is in an enclosure including a cylinder such that the enclosure is filled with oil. A ball check valve 32 in the bottom of the piston/cylinder assembly 30 functions to allow oil from a reservoir 27 (wobble plate 28 is in the reservoir) to fill the enclosure on the suction stroke. During the output or pumping stroke, the held oil in the enclosure pressurizes the back side of diaphragm 34, and as the wobble plate moves, causes the diaphragm to flex forward to provide the pumping action. Ideally, the pump hydraulically balances the pressure across the diaphragm over the complete design pressure range. As discussed later, in actual practice this is not the case for all situations for known pumps. In any case, each diaphragm has its own pumping chamber which contains an inlet and an outlet check valve assembly 36, 37 (see also FIG. 2). As the diaphragm retracts, process fluid enters the pump through a common inlet and passes through one of the inlet check valves. On the output or pumping stroke, the diaphragm forces the process fluid out the discharge check valve and through the manifold common outlet. The diaphragms, equally spaced 120° from one another, operate sequentially to provide constant, virtually pulse-free flow of process fluid.

In more detail, a portion of a diaphragm pump 20 is shown in cross-section in FIG. 2. The diaphragm 34 is held between two portions 38, 40 of housing 24. Diaphragm 34 separates the pump side from the oil-filled, hydraulic drive side of the pump. On the drive side, a drive piston assembly 30 including a diaphragm plunger 42 are contained within the oil filled enclosure which functions as a transfer chamber 44. A plurality of check valves 32 in piston 46 separate transfer chamber 44 from the oil reservoir (not shown). Wobble plate 28 (not shown in FIG. 2) contacts pad 48 to drive piston 46. Arrow 49 indicates the general direction of movement of the cam or wobble plate. When the piston and diaphragm have finished the forward or pumping stroke, the end 50 of piston 46 is at top dead center (TDC). When the piston and diaphragm have retracted in the suction stroke, the end 50 of piston 46 is at bottom dead center (BDC).

Piston 46 reciprocates in cylinder 47. Piston 46 has a sleeve section 52 which forms the outer wall of the piston. Sleeve section 52 includes a sleeve 54 and an end portion 56 at the end having pad 48 which is contact with the wobble plate. Within sleeve 54 is contained a base section 58. Base section 58 includes a first base 60 which is in contact with end portion 56 and includes seal elements 62 for sealing between first base 60 and sleeve 54. Base section 58 also includes second base 64 at the end opposite of first base 60. Connecting wall 66 connects first and second bases 60 and 64. Piston return spring 68 is a coil spring which extends between first base 60 and diaphragm stop 70 which is a part of the pump housing 24. Valve housing 72 is contained within base section 58 and extends between second base 64 and end portion 56. Seals 74 provide a seal mechanism between valve housing 72 and connecting wall 66 near second base 64.

The end 76 opposite end portion 56 of sleeve portion 52 is open. Likewise, the end 78 of valve housing 72 is open. Second base 64 has an opening 80 for receiving the stem 82 of plunger 42.

Diaphragm plunger 42 has the valve spool 84 fitted within valve housing 72 with the stem 82 extending from the valve spool 84 through opening 80 to head 86 on the transfer chamber side of diaphragm 34. Base plate 88 is on the pumping chamber side of diaphragm 34 and clamps the diaphragm to head 86 using a screw 90 which threads into the hollow portion 92 of plunger 42. Hollow portion 92 extends axially from one end of plunger 42 to the other end. Screw 90 is threaded into the diaphragm end. The piston end of hollow portion 92 is open. A plurality of radially directed openings 94 are provided in stem 82. A bias spring 96 is a coil spring and extends between second base 64 and valve spool 84. A valve port 98 is provided in the wall of valve housing 72. A groove 100 extends in connecting wall 66 from the furthest travel of valve port 100 to end portion 56. A check valve 102 is formed in end portion 56 in a passage 104 which is fluid communication with the reservoir (not shown). Thus, there is fluid communication from the reservoir (not shown) through passage 104 and check valve 102 via groove 100 to valve port 98. When the valve is open, there is further communication through the space in which coil spring 96 is located and then through one of the plurality of radial openings 94 and through the axial hollow portion 92 of plunger 84. There is further fluid communication from the hollow portion 92 through the other radially directed openings 94 to various portions of transfer chamber 44. The hollow passage 92, along with the radially directed openings 94 provide fluid communication from the portion of transfer chamber 44 near diaphragm 34 to the portion of transfer chamber 44 within the valve housing 72 of piston 30. The transfer chamber also includes the space occupied by piston return spring 68.

On the pump side of diaphragm 34, there is an inlet check valve assembly 36 which opens during the suction stroke when a vacuum is created in pumping chamber 106. There is also a check valve 37 which opens during the pumping or output stroke when pressure is created in pumping chamber 106.

FIGS. 3(*a*)–(*f*) illustrate operation of the conventional pump 20 under normal, standard operating conditions using a conventional bias spring 96. Typical pressures are shown. Typical vector directions for the cam or wobble plate (not shown in FIGS. 3(*a*)–(*f*)) are shown. Suction is less than 14.7 psia. Output pressure is greater than 14.7 psia. The pressure differential across diaphragm 34 is set at about 3 psi.

With reference to FIG. 3(*a*), the suction stroke begins at the end of the pumping stroke. For the conditions assumed, pressure in the pumping chamber immediately drops from what it was at high pressure, for example, 120 psia to 10 psia. Pressure in the hydraulic transfer chamber is 13 psia which is less than the 14.7 psia in the reservoir. The piston 30 is at top dead center and begins moving toward bottom dead center. Bias spring 96 momentarily moves plunger 42, and particularly valve spool 84, to the right to open port 98. Because pressure in the transfer chamber is less than the pressure in the reservoir, check valve 32 opens and oil flows from the reservoir to the transfer chamber to appropriately fill it with oil which had been lost during the pumping stroke previous. That is, under the pressure of the pumping stroke oil flows through somewhat loose tolerances of the parts of the piston so that some of the oil flows from the transfer chamber back to the reservoir. Thus oil needs to be refilled in the transfer chamber during the suction stroke so that there is enough oil to efficiently provide pressure during the next pumping stroke.

FIG. 3(*b*) shows the configuration at mid-stroke. The slight suction in the pumping chamber (shown to be 10 psia), holds diaphragm 34 and spool 84 to the left while piston 30 moves to the right, thereby shutting off port 98. Since pressures are nearly equal and diaphragm 34 moves right with piston 30, the pumping chamber fills with process fluid.

As shown in FIG. 3(*c*), process fluid continues to fill as diaphragm 34 moves right. Valve port 98 remains shut. Very little leakage of oil occurs from the reservoir (not shown) to transfer chamber 44, since pressures are nearly equal. Thus, both sides of the diaphragm fill properly.

When piston 30 reaches bottom dead center, the suction stroke is completed and the output or pumping stroke begins as shown in FIG. 3(*d*). Pressure in the transfer chamber immediately increases, for example, from 13 psia to 123 psia. Likewise, pressure in the pumping chamber immediately increases, for example, from 10 psia to 120 psia. The wobble plate begins moving piston 30 to the left which causes the build-up of pressure. Check valves 32 close. Diaphragm 34 moves in volume tandem with the oil and process fluid left with the piston to push (pump) process fluid out.

At mid-stroke as shown in FIG. 3(*e*), there is continued output. Some oil leakage past the tolerances between piston and cylinder may move valve spool 84 of diaphragm plunger 42 to the right to open valve port 98. Check valves 32, however, are closed, thereby locking the oil in transfer chamber 44, except for leakage.

The output stroke finishes with the configuration shown in FIG. 3(*f*). The filled transfer chamber 44 pushes diaphragm 32 to the left dispensing process fluid as it moves. Normal operation as shown in FIGS. 3(*a*)–(*f*) causes little stress on diaphragm 32.

A problem with conventional diaphragm pumps, however, is an unexpected diaphragm rupture under certain operating conditions. The, diaphragm can fail much sooner than normal, or more frequently, may fail sooner than other pump components. A failure contaminates the process lines with drive oil. The operating condition which most often causes failure is a high vacuum inlet with a corresponding low outlet pressure. This is an expected occurrence in a typical pumping system when the inlet filter begins to plug. In that case, the plugging requires high vacuum to now pull process fluid through the filter. At the same time, the lowering of process fluid volume pumped drops the outlet pressure. This creates a situation where a high suction on the pumping side lowers the pressure during the suction stroke on the transfer chamber side so that the transfer chamber essentially "asks for more fill fluid" and, consequently, in-flowing oil overfills the transfer chamber and does so without a corresponding high pressure to push oil out during the pumping or output stroke to counter-balance. The overfill of oil "balloons" the diaphragm into the fluid valve port until the diaphragm tears. Additionally, with a high-speed, reversing, vacuum/pressure pump such as this apparatus, the high-speed valve closings create tremendous pressure spikes, called Jaukowski shocks. The spikes can consist of fluid pressure or acoustical waves and harmonics of both. These pressure spikes can "call for" oil fluid flow into the drive piston when that should not be happening. Again, this can cause overfill and lead to the diaphragm failure. FIGS. 4(*a*)–4(*f*) are provided to illustrate the overfill failure mode.

In FIG. 4(*a*), the suction stroke begins. Since it is assumed that the inlet side for the process fluid is plugged or blocked off, only a low pressure was created during the output stroke. That is, the pressure in the pumping chamber 106 was, for example, 14 psia and goes to 10 psia as it did in FIG. 3(*a*). The suction, however, quickly increases the vacuum so that pressure in the pumping chamber 106 drops further to, for example, 3 psia as shown in FIG. 4(*b*). The diaphragm 34 and plunger 42 stay too far left keeping valve port 98 closed and bias spring 96 somewhat compressed. There is only momentary oil flow through check valves 32, valve port 98 and the various passageways in stem 82.

At mid-stroke of the suction stroke as shown in FIG. 4(*b*), any diaphragm movement right causes a higher vacuum in pumping chamber 106 which tends to hold diaphragm 34 and plunger 42 to the left, while piston 46 moves to the right. Valve port 98 is shut off, but nevertheless because of the lower pressure, for example, 6 psia, being developed in transfer chamber 44, there is oil leakage due to the tolerances in the system from the reservoir (not shown) to transfer chamber 44. The weak bias spring 96 in the conventional diaphragm pump allows plunger 42, and particularly valve spool 84, to stay too far left and allow the lower pressure in transfer chamber 44 to develop and continue.

As shown in FIG. 4(*c*), at the end of the intake or suction stroke, the plunger 42 and diaphragm 34 remain too far left, and the low pressure in transfer chamber 44 continues to cause leakage and after many strokes like this, transfer chamber 44 gets overfilled with oil prior to starting the output stroke.

The configuration at the beginning of the output stroke is shown in FIG. 4(*d*). Piston 46 starts to move left. Since there is low pressure in the pumping chamber 106, pressure does not build in transfer chamber 44 until later in the output stroke.

As shown at mid-stroke in FIG. 4(*e*), the overfilled oil transfer chamber 44 moves diaphragm 34 and valve spool 84 to the left at the same rate. When base plate 88 and diaphragm 34 approach wall 108 on the pumping side of the pump, pressure finally rises in transfer chamber 44. The short time in which there is pressure greater than 14.7 psia, which is the pressure in the reservoir, is not enough time to allow oil leakage back from transfer chamber 44 to the reservoir to balance flow leakage during the suction stroke.

Hence, the diaphragm 34 distorts due to the oil overfilling in transfer chamber 44. The weak spring 96 is compressed.

The end of the output stroke is shown in FIG. 4(*f*). Overfilled transfer chamber 44 pushes base plate 88 fully against wall 108 and diaphragm 34 stretches into the port of outlet check valve assembly 37. A rapid rise in pressure in transfer chamber 44 at this time eventually causes diaphragm 34 to either cut on various surfaces it encounters or to burst. At this point, the pump fails. As a result, there can be contamination of process fluid remnants into piston assembly 30 and contamination of oil into the process fluid line.

Thus, when a high vacuum (that is, a plugged filter or inlet valve shut off) exists on the pumping chamber side of the diaphragm, the diaphragm does not want to move with the piston. This would not ordinarily cause a problem, as the valve spool 84 and valve port 98 close. If this condition exists, however, for a long period of time, the leakage between the valve spool and the valve port plus the leakage between the piston and the housing combine to allow oil overfill in the transfer chamber. On the output stroke, the pressure must be high enough to re-expel leakage volume. It can expel, however, only around the piston and housing since the ball check valves 32 prevent any exiting through the valve port. Since the pump inlet is blocked and unable to pump much process fluid volume, pressure during process fluid outlet is low and/or only for part of the stroke. Empirically, it has been found that the outlet pressure must be more than 100 psig in order to "leak as much out as in". If the pump does not leak as much out of the transfer chamber as it leaks in, then the added volume is powered by the drive piston until the diaphragm balloons and enters ports or crevices and causes rupture.

Conventional pump 20 also has the problem that valve spool 84 can stick to burrs in particular at the edge of openings for valve ports 98. In this type of situation, diaphragm 34 tends to wrap around base plate 88 thereby stressing and/or pinching the diaphragm material.

Conventional pump 20 has the further problem of volumetric inefficiency. This occurs because there is not a large enough bypass leakage of oil (and air) around the piston to purge the air from the transfer chamber. Under this condition, efficiency decreases as more and more air accumulates within the transfer chamber. This decreased volumetric efficiency occurs because the piston repeatedly compresses and decompresses the excess of air caught in the transfer chamber. This causes more and more severe fluid pressure pulsation because air compressing changes the diaphragm stroke from pure sinusoidal form to almost a square form. A direct result of this is increased pressure fluctuation at the pump outlet, an undesirable characteristic of a diaphragm pump.

SUMMARY OF THE INVENTION

The present invention is directed to a diaphragm pump which receives drive power from a motor. The pump has a casing which houses a pumping chamber adapted to contain fluid to be pumped (process fluid), a transfer chamber adapted to contain hydraulic fluid (oil), and a hydraulic fluid reservoir. The pump has a diaphragm having a transfer chamber side and a pumping chamber side. The diaphragm is supported by the casing and is disposed between the pumping chamber and the transfer chamber and is adapted for reciprocation toward and away from the pumping chamber. The pump has a piston in a cylinder in the casing adapted for reciprocation of the diaphragm between a power stroke and a suction stroke.

The cylinder forms a portion of the transfer chamber. The piston moves longitudinally in the cylinder with the cylinder when the pump is oriented so that the cylinder is generally horizontal having a surface with an upper portion. A wobble plate and a first spring cooperate to reciprocate the piston. The wobble plate is driven by the motor. The first spring is compressible between the housing and the piston. A second spring urges the diaphragm away from the pumping chamber with a first end of the second spring connected with the diaphragm and a second end of the second spring supported by the piston for movement therewith. A fluid communication path for the hydraulic fluid is formed between the hydraulic fluid reservoir and the transfer chamber. A valve in the fluid communication path allows selectively flow of hydraulic fluid from the hydraulic fluid reservoir to the transfer chamber when the valve is open. A vent is formed in the upper portion of the surface of the cylinder. In this way, air in the transfer chamber is forced from the transfer chamber throughout the vent in the cylinder so as so enhance the quality of the fluid remaining in the transfer chamber and to self-prime the pump.

In this way, the present invention discloses a novel diaphragm pump that "spits" out small amounts of trapped air and oil through the vent on each cycle of the pump. It does this only at a point in the stroke where no large shock pressures are occurring. Having only non-compressing oil in the cylinder provides "solid" displacement to enhance metering of oil, volumetric efficiency, and outlet pressure stability of the pump. Removing air prevents the problems caused by accumulated air entrapment, including the inability to self-prime. This simplifies final assembly, final test, and user operation. The present invention maintains the biased oil drive as described in U.S. Pat. No. 3,775,030. The present invention, however, discloses use of a stiff bias spring. In this way, at high vacuum conditions, the bias spring keeps drive oil pressure above its vapor pressure, which prevents oil cavitation, and (2) the bias spring overcomes suction forces in the pumping chamber and prevents oil overfill in the transfer chamber (so the diaphragm does not fail).

Thus, the improvements disclosed herein optimize durability and efficiency for a diaphragm pump.

DETAILED DESCRIPTION OF THE PREFERRED EMBODIMENT

The present invention is an improvement to the conventional diaphragm pump described above. Like parts are designated by like numerals. Improved parts are distinguished and described. It is understood that the improved parts lead to a synergistic improvement of pump performance and durability.

Figure 5:
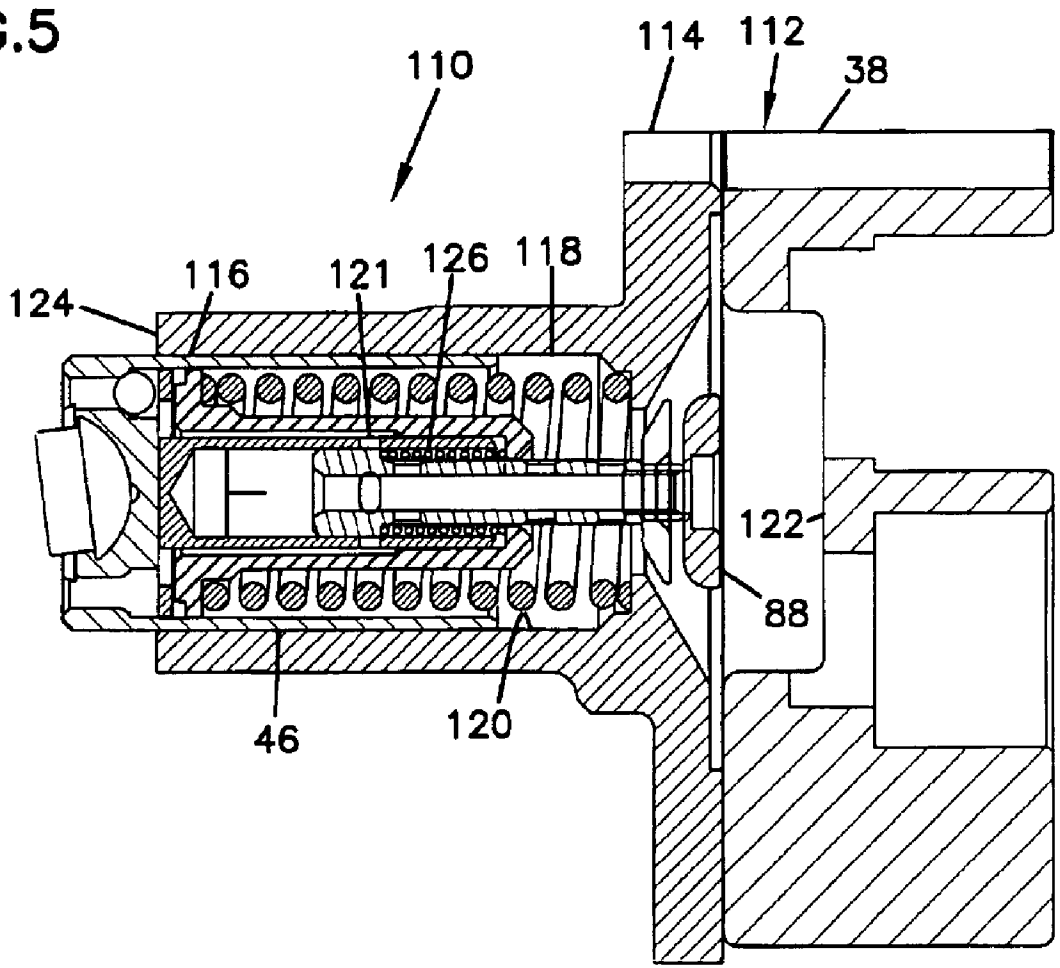
FIG. 5 is a partial cross-sectional view of a diaphragm pump in accordance with the present invention.

With reference to FIG. 5, the present invention is embodied in pump 110. Housing 112 comprises portions 38, 114 which are similar to portions 38, 40 of housing 24. Portion 114 includes a vent with a form of a notch 116 formed in the upper portion 118 of the surface of cylinder 120, which is similar to cylinder 47. Notch 116 provides fluid communication between transfer chamber 44 and the oil reservoir (not shown). Although notch 116 is shown to extend from beyond the right end of piston 46 in cylinder 120 when piston 46 is as far right as it can travel, namely, when base plate 88 contacts wall 122 of housing portion 38, the preferred embodiment has the notch extending just past the halfway forward travel of the piston. Thus the piston will "valve off" the notch passage during the final half of the output stroke and the first half of the suction stroke. The notch will open to expel air and oil just before midpoint of the suction stroke and stay open till just past midpoint of the output stroke. This has empirically proven to provide the required easy priming while minimizing leakage. Notch 116 extends to the left to the end 124 of housing portion 114 where it opens to the oil reservoir.

It is further noted that pump 110 has a significantly stiffer bias spring 126. The combination of the significantly stiffer bias spring 126 and notch 116 leads to virtual elimination of diaphragm failure when a high vacuum condition develops on the pumping side of the diaphragm and also leads to reduction of air in the hydraulic fluid in transfer chamber 44 and, consequently, allows pump 110 to achieve self-priming.

Figure 6:
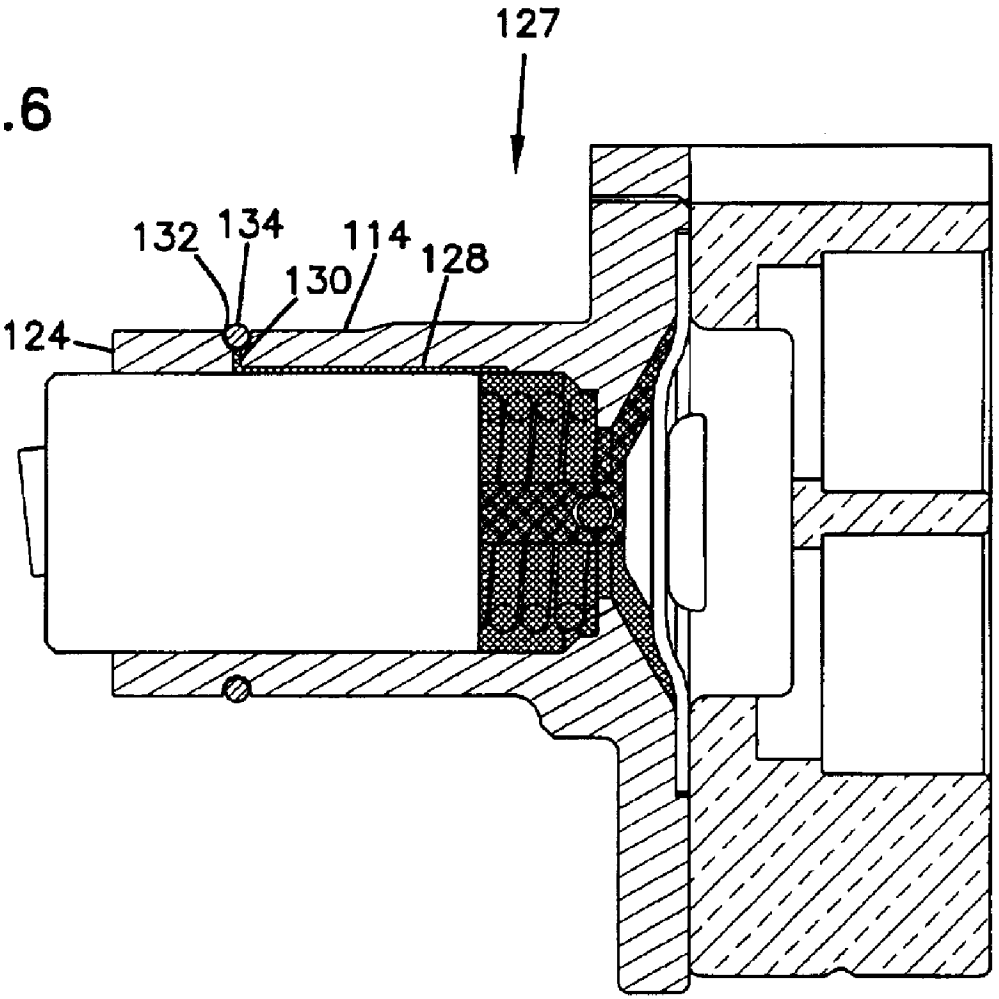
FIG. 6 is a partial cross-sectional view of a first alternate embodiment.

A first alternate embodiment of the present invention is shown in FIG. 6. Pump 127 shows a notch 128, similar to notch 116, except notch 128 does not extend all the way to end 124. Rather, a radially extending passage 130 in said housing portion 114 extends from the end of notch 128 near end 124 to an O-ring groove 132. O-ring 134 is provided in groove 132.

O-ring 134 in groove 132 functions as a check valve. Whenever sufficient pressure exists in transfer chamber 44, the pressure will slightly open O-ring 134 from passage 130 to allow air/oil to be expelled into the reservoir (not shown). With this embodiment, fluid flows only out through notch 128, passage 130 and the check valve of O-ring 134 and groove 132, as opposed to two-way flow through notch 116 of pump 110.

Figure 7:
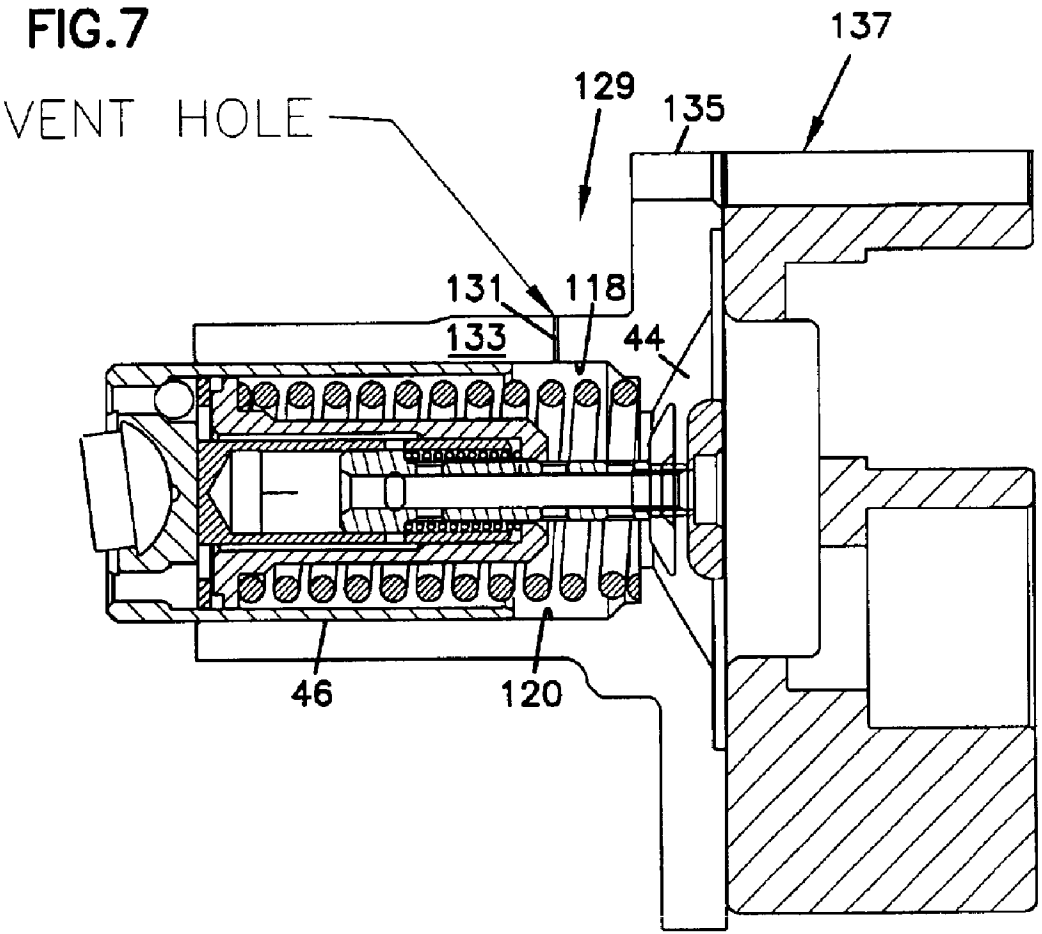
FIG. 7 is a partial cross-sectional view of a second alternate embodiment.

A second alternative embodiment of the present embodiment is shown in FIG. 7. Pump 129 shows a passage 131 extending from the upper portion 118 of cylinder 120. Passage 131 extends through wall 133 of portion 135 of housing 137. Passage 131 provides fluid communication between transfer chamber 44 and the hydraulic fluid reservoir. Preferably, passage 131 extends radially and vertically. Preferably also, passage 131 is located just past the halfway forward travel of piston 46. Thus, piston 46 will "valve off" the passage during the final half of the output stroke and the first half of the suction stroke. The passage will open to expel air and oil just before the midpoint of the suction stroke and stay open until just past the midpoint of the output stroke. Thus, passage 131 provides similar function as notch 116.

Figure 8:
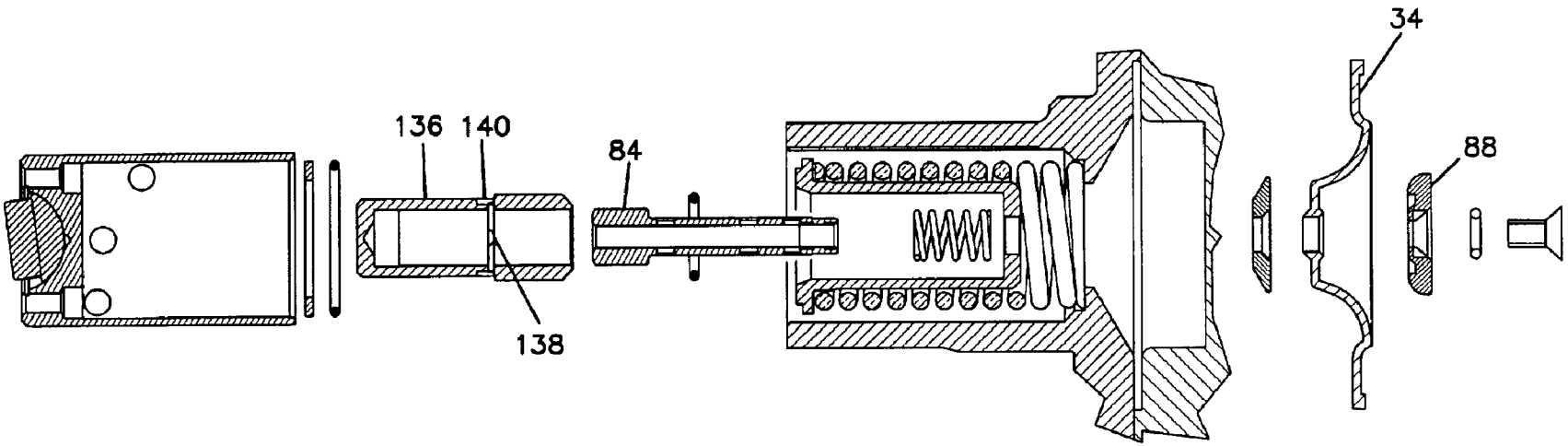
FIG. 8 is an exploded, cross-sectional view of a piston/cylinder assembly.

Another feature of the present invention which is relevant to all embodiments is shown in FIG. 8. Valve housing 136 includes a circumferential groove 138 which is axially located so as to intersect with valve port 140. Without groove 138, there is a chance of a burr being formed when the radial valve port opening is manufactured. If there is a burr present, then valve spool 84 can get caught on the burr so that the spool sticks. In this case, the diaphragm 34 may wrap around base plate 88 and become stressed and/or pinched. By forming the circumferential groove 138, the possibility of such a burr is eliminated.

Figure 9D:
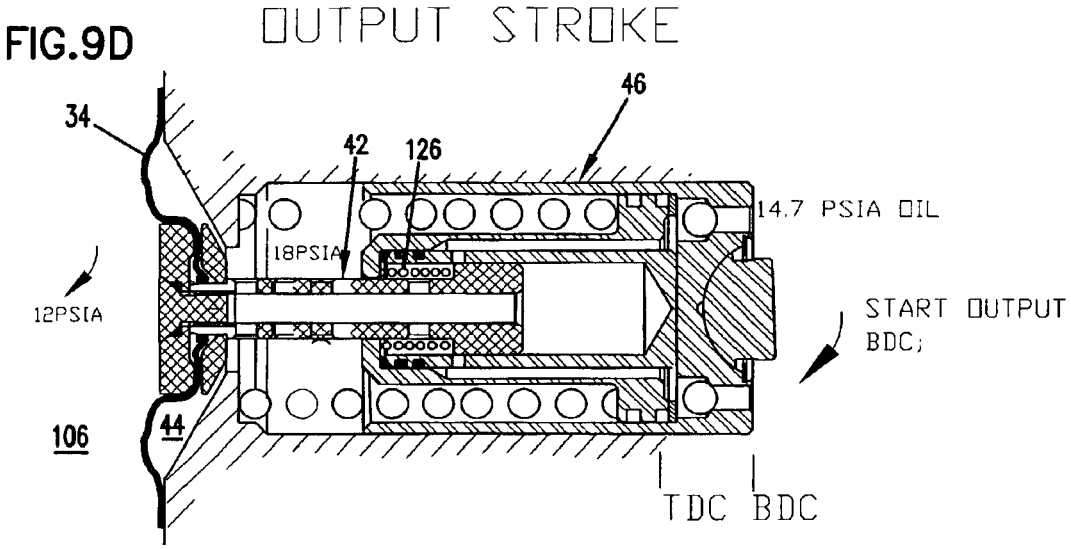
FIGS. 9(*a*)–9(*f*) are partial cross-sectional views of a diaphragm pump illustrating operation with a high spring constant bias spring.
Figure 9E:
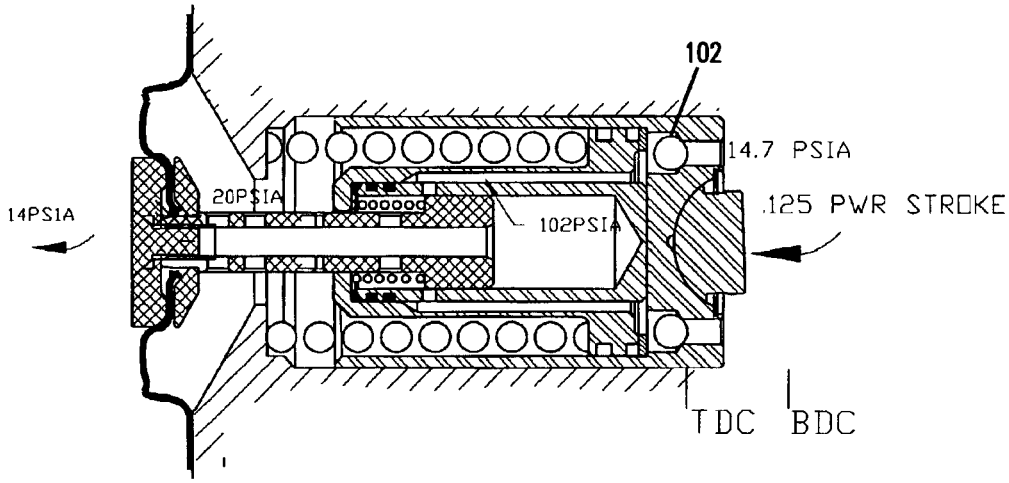
Figure 9F:
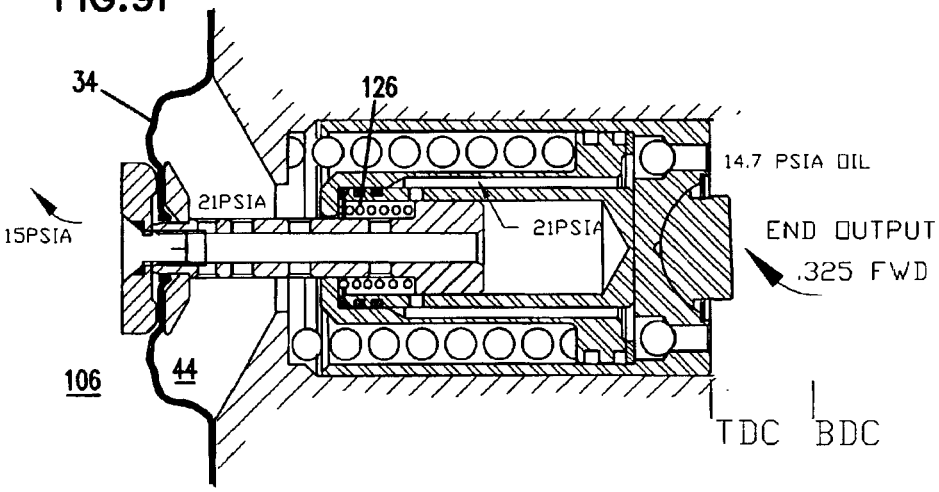

In operation, a design configuration wherein a pump in accordance with the present invention has a stiff bias spring 126, as distinguished from a weak bias spring 96, is described with respect to FIGS. 9(*a*)–(*f*). A weak bias spring 96 of a conventional pump is distinguished from a stiff bias spring 126 in FIG. 10.

Figure 1:
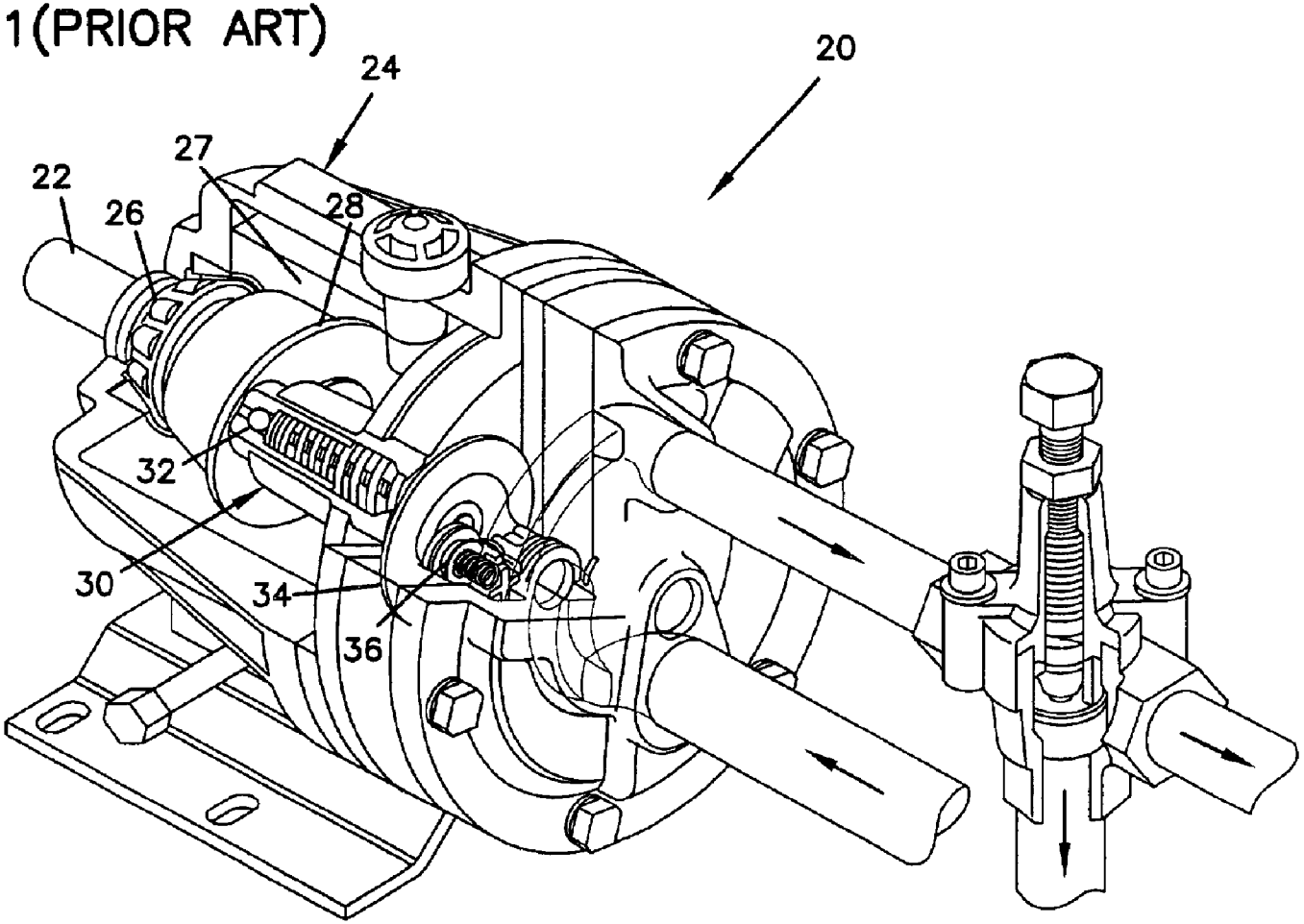
FIG. 1 (PRIOR ART)
FIG. 1 is a perspective view of a conventional diaphragm pump.
Figure 2:
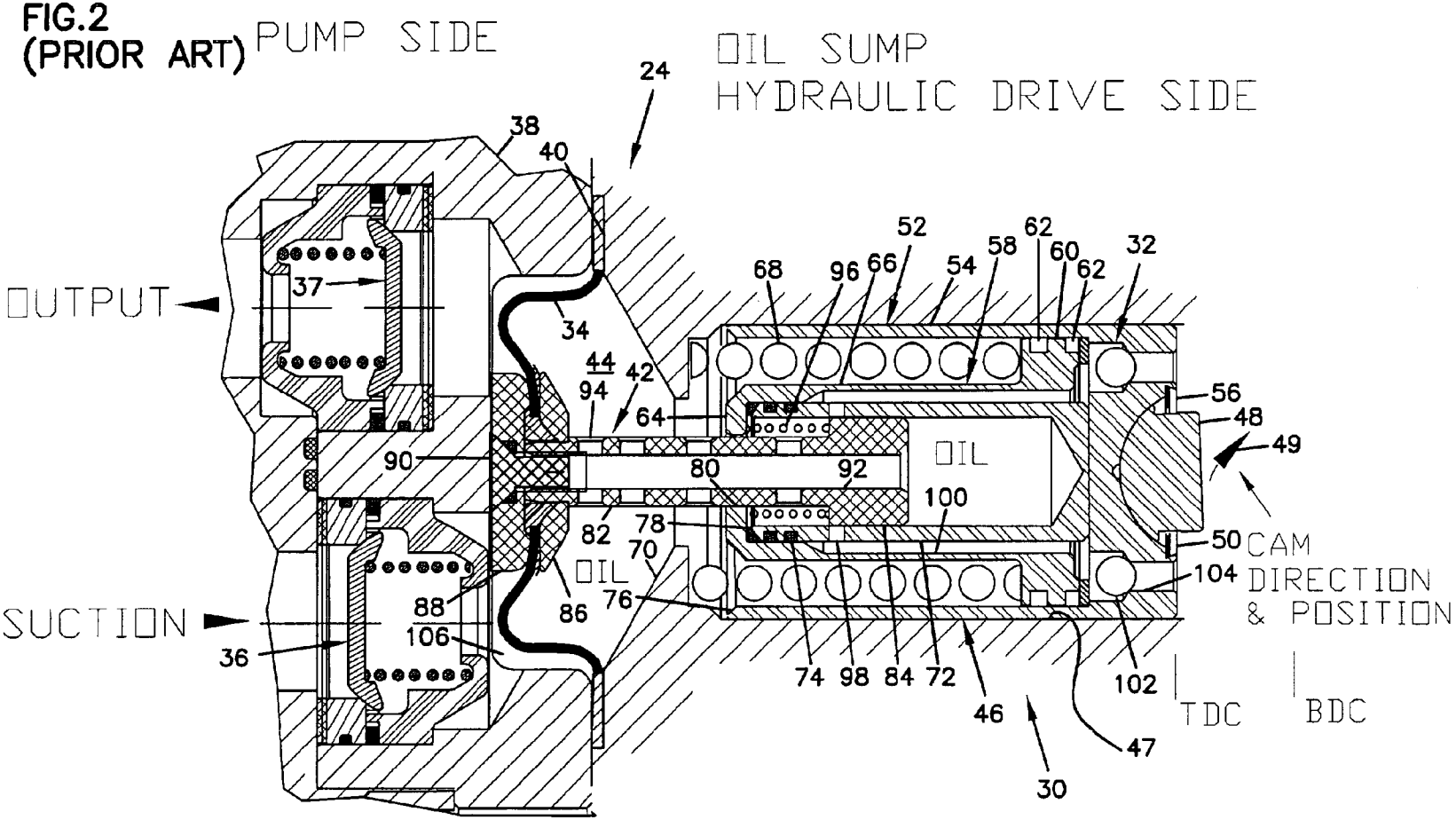
FIG.2 (PRIOR ART)
FIG. 2 is a partial cross-sectional view of a conventional diaphragm pump.
Figure 3A:
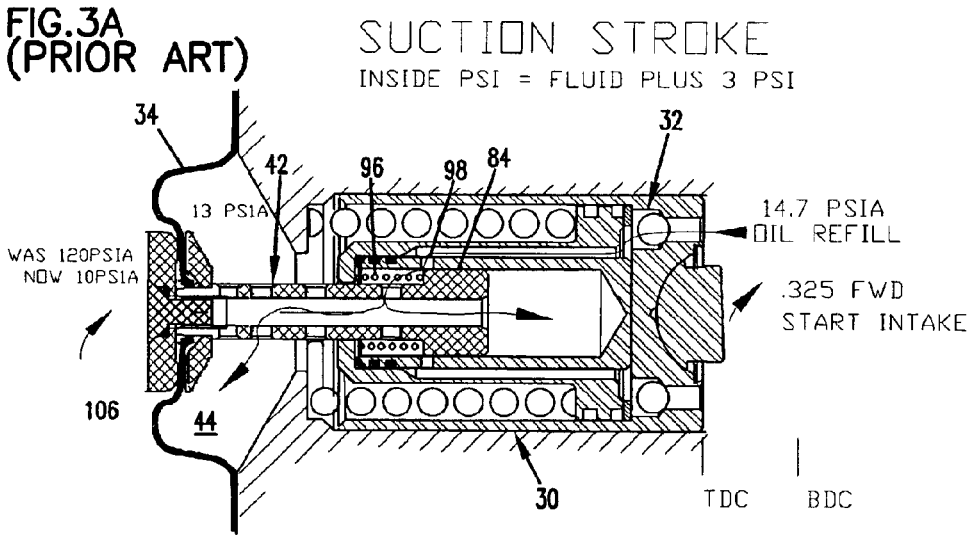
FIG.3A (PRIOR ART)
FIGS. 3(*a*)–3(*f*) are partial cross-sectional views of a conventional diaphragm pump illustrating normal conditions.
Figure 3B:
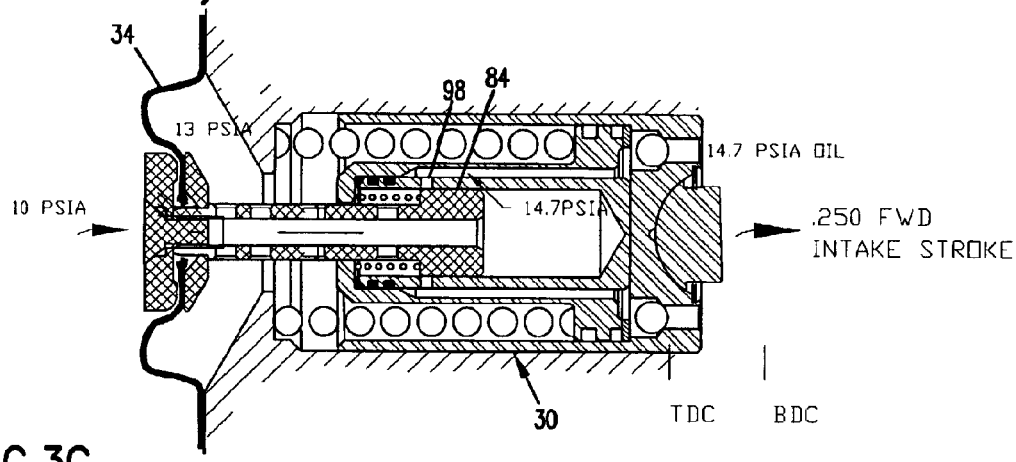
FIG.3B (PRIOR ART)
Figure 3C:
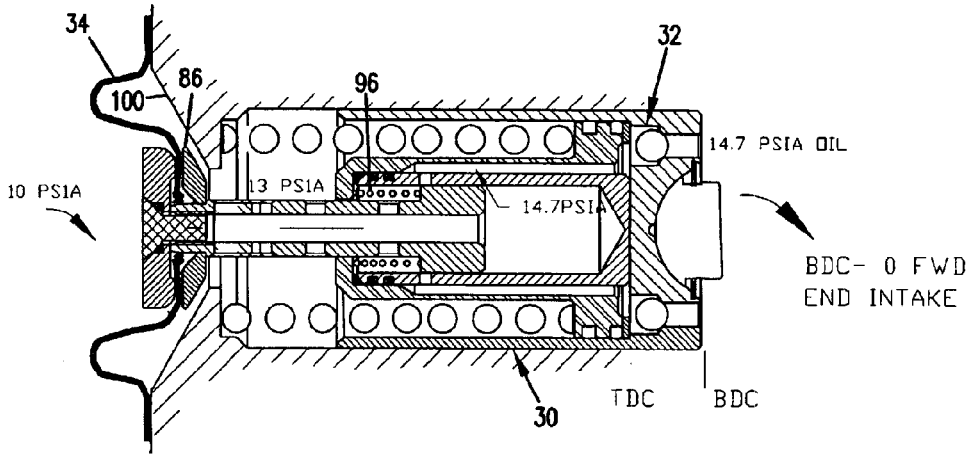
FIG.3C (PRIOR ART)
Figure 3D:
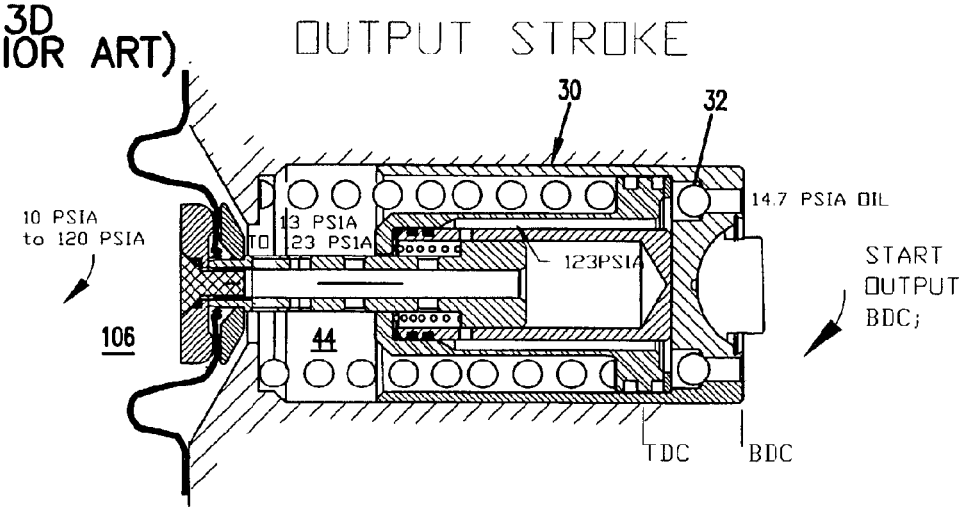
FIG.3D (PRIOR ART)
Figure 3E:
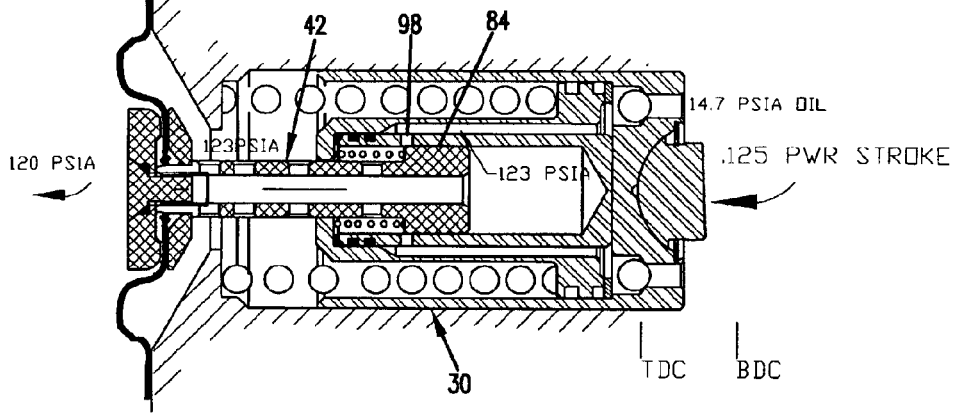
FIG.3E (PRIOR ART)
Figure 3F:
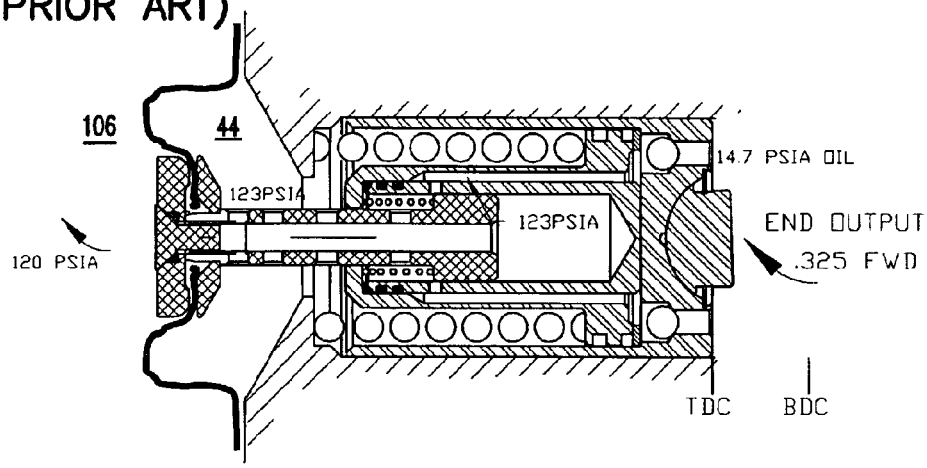
FIG.3F (PRIOR ART)
Figure 4A:
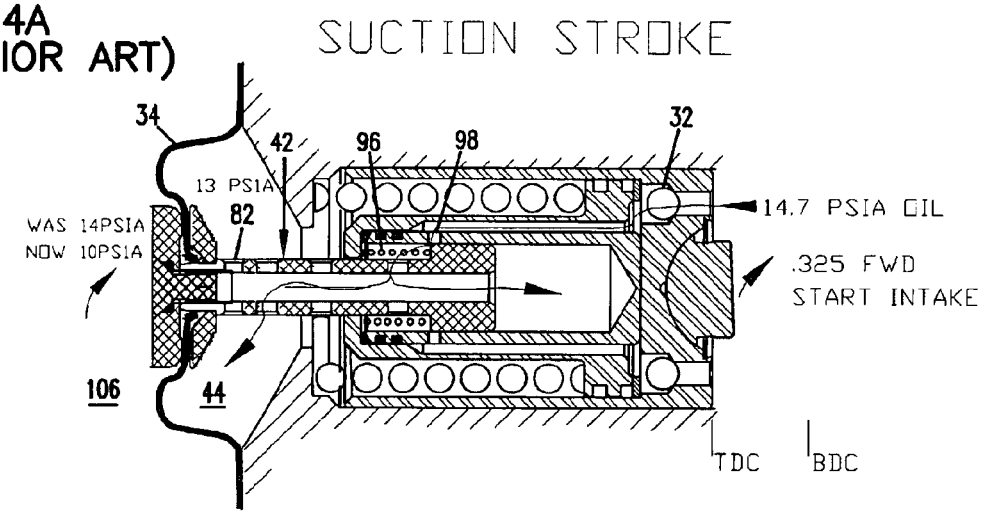
FIG.4A (PRIOR ART)
FIGS. 4(*a*)–4(*f*) are partial cross-sectional views of a conventional diaphragm pump illustrating a high vacuum condition resulting in diaphragm failure.
Figure 4B:
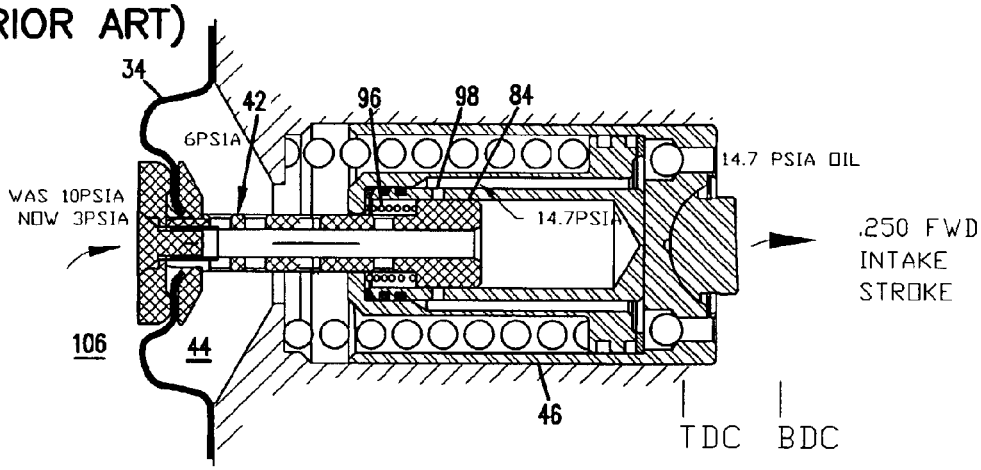
FIG.4B (PRIOR ART)
Figure 4C:
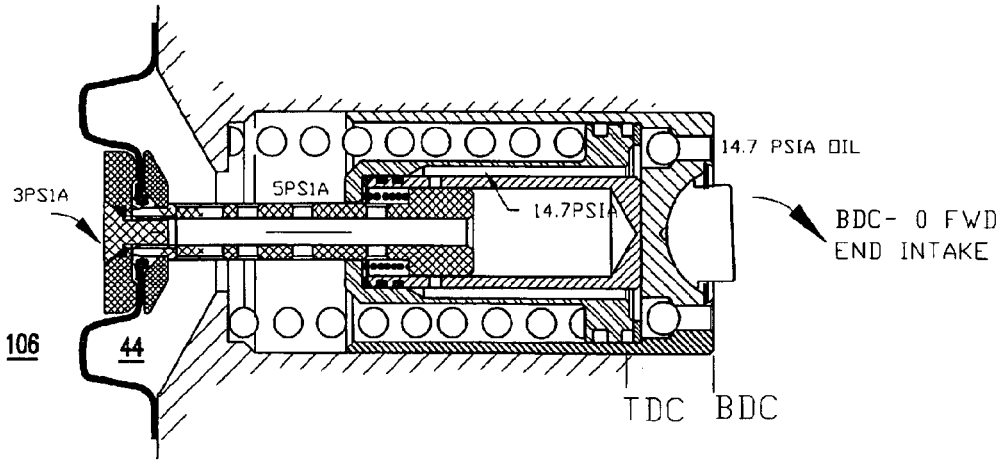
FIG.4C (PRIOR ART)
Figure 4D:
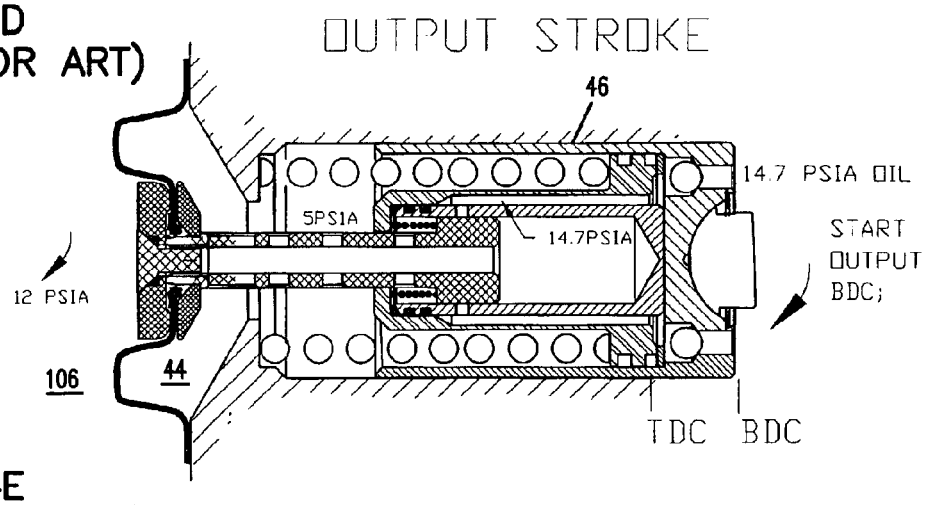
FIG.4D (PRIOR ART)
Figure 4E:
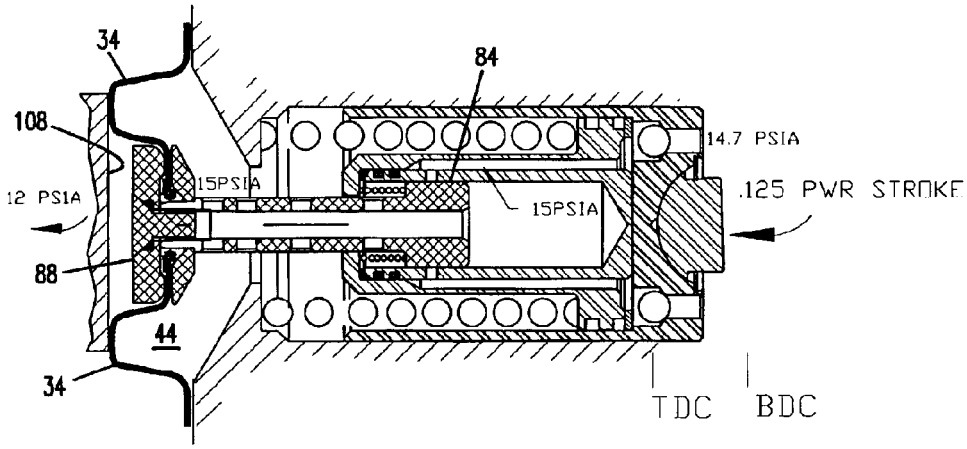
FIG.4E (PRIOR ART)
Figure 4F:
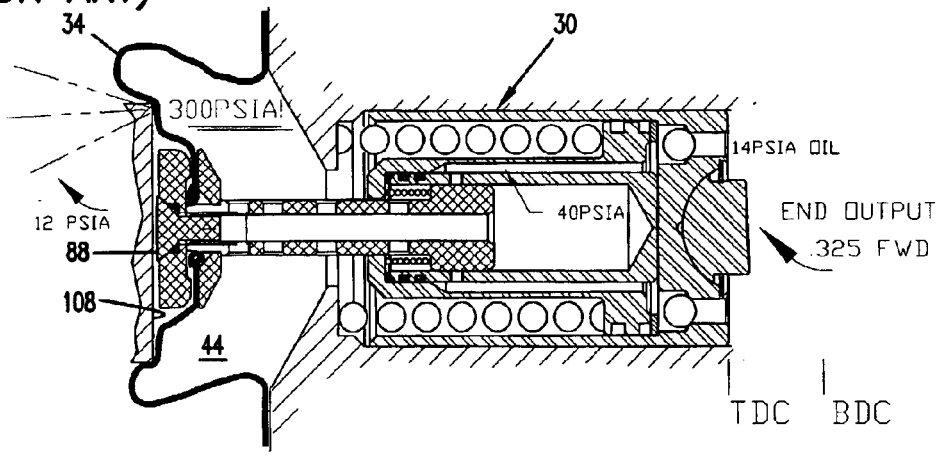
FIG.4F (PRIOR ART)
Figure 10:
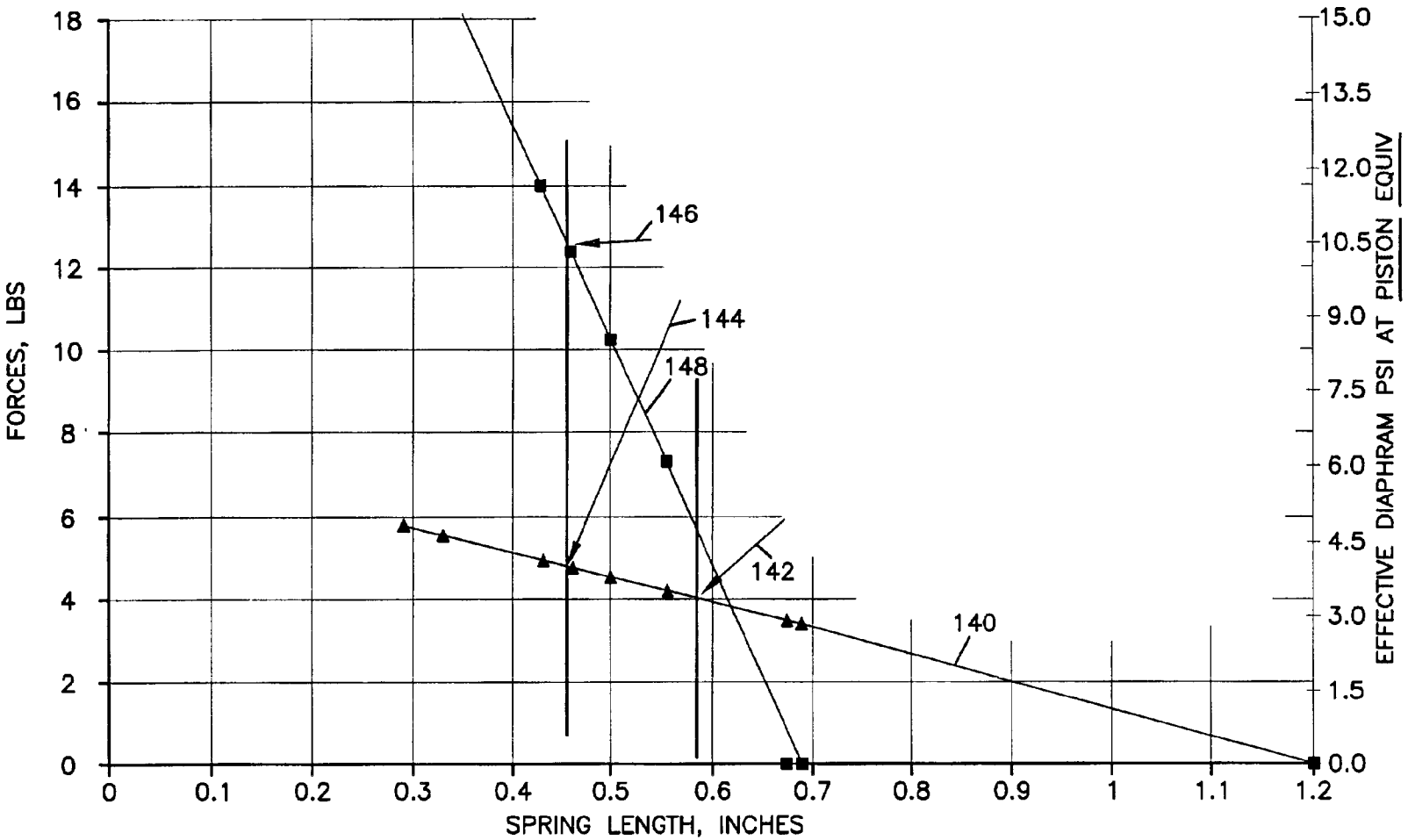
FIG. 10 is a graph illustrating a weak conventional bias spring and a strong bias spring in accordance with the present invention.

FIG. 10 is a graph which shows spring length in inches along the X-axis. On the left side along the Y-axis, the graph is calibrated for force in pounds which the piston exerts on the diaphragm. Along the right side for the Y-axis, an effective pressure at the diaphragm in pounds per square inch (psi) is provided. In the conventional pump, it is known from U.S. Pat. No. 3,775,030, that a small over-pressure, for example, 3 psi, should be provided in the transfer chamber 44 in order for the pump to work properly under normal conditions. As consequence, the conventional thinking has been to provide a weak spring so that the over-pressure maintained by the bias spring does not differ too greatly from 3 psi for various spring lengths during the compression of normal operation. A spring constant for a typical spring is shown as line 140 in FIG. 10. However, as discussed above with respect to FIGS. 4(*a*)–4(*f*) the conventional pump has the problem of the diaphragm 34 failing if the line providing process fluid to the pump becomes plugged, such as when a filter gets dirty. Thus, with respect to the present invention, two reference points were considered. A first reference point occurs when valve port 121 in FIG. 5 or valve port 98 in FIG. 2 just turns off or is closed. At the point at which valve port 98 just turns off, the bias spring should counteract fluid suction on the fluid pumping side adequately to prevent the suction from holding the diaphragm to that side and thereby allowing unwanted oil to fill into the transfer chamber. The minimum, of course, is zero since clearly a negative pressure would constantly call for more oil in the transfer chamber and be undesirable. Experience with the conventional pump as discussed above has shown that 3 psi works well. Somewhat greater, up to 4 psi or so, is acceptable. Therefore, a range of zero-4 psi is appropriate. Reference point 1 is shown at numeral 142 in FIG. 10.

The second reference point occurs when transfer chamber 44 has filled with oil to its maximum, that is, when base plate 88 contacts wall 108 as shown in FIG. 4(*f*). The second reference point is shown at numeral 144. For weak spring 140, the pressure at valve shut off reference point 142 is slightly greater than 3 psi and at maximum overfill reference point 144 the pressure is about 4 psi. Conventionally, this has been the design for bias spring 96. In order to solve the problem of diaphragm failing for a high vacuum condition in the pumping chamber of the pump, however, it was determined that it was necessary to) approximately satisfy reference point 1 with respect to normal operating conditions, and with respect to the condition of high vacuum, it was determined that the spring should provide a pressure in transfer chamber 44 of about 10.5 psi as shown at numeral 146 in FIG. 10, which does not allow a large pressure differential between the reservoir and the transfer chamber. The reservoir is atmospheric, or essentially 14.7 psi. These two reference points when connected by a straight line then determine the spring constant for the improved pump.

FIGS. 9(*a*)–9(*f*) illustrate operation with respect to a stiff spring of the type represented by line 148 in FIG. 10.

FIGS. 9(*a*)–9(*f*) assume the stiff bias spring and a vacuum condition, that is, a plugged process line. FIGS. 9(*a*)–9(*f*) are similar to FIGS. 4(*a*)–4(*f*), except the weak bias spring is replaced by the stiff bias spring.

In FIG. 9(*a*), the suction stroke begins. Since the inlet for the process fluid is blocked off, no pressure was created on the output stroke so that suction on the suction stroke quickly brings a vacuum condition in the pumping chamber 106. The diaphragm 34 and plunger 42 stay too far left and close port 121 and compress somewhat bias spring 126.

With reference to FIG. 9(*b*), a configuration at mid-stroke is shown. The lower pressure in pumping chamber 106 which then causes a lower pressure in transfer chamber 44 holds diaphragm 34 and plunger 42 to the left but cannot hold them as far left as in the conventional pump as shown in FIG. 4(*b*), because of the stiff bias spring with the higher spring constant 146. Overfill of transfer chamber 44 is consequently limited to the volume of stretch of diaphragm 34 under these conditions.

The suction stroke reaches its end in FIG. 9(*c*) at bottom dead center. The high suction in the pumping chamber is still present, but the stiff spring (see reference point 2 in FIG. 10) counterbalances the suction force thereby raising the pressure in transfer chamber 44 and preventing overfilling of transfer chamber 44 prior to starting the output stroke. For example, in a preferred case, the differential pressure in the transfer chamber versus the pumping chamber is about 10.5 psi for the bias spring to counterbalance.

The output stroke begins as shown in FIG. 9(*d*). Piston 46 moves to the left since there is very low pressure in the pumping chamber. Pressure does not build in the transfer chamber except as caused by the stiff bias spring 126, so diaphragm 34, plunger 42, and piston 46 move together.

At mid-stroke as shown in FIG. 9(*e*), check valves 102 stay closed and the stiff spring 126 biases to cause leakage out of the transfer chamber rather than into it.

The output stroke finishes as shown in FIG. 9(*f*). Since transfer chamber 44 has not overfilled, diaphragm 34 does not balloon and normal operation continues in spite of the plugged inlet line to the pumping chamber. Hence, the stiff bias spring 126 prevents the failure mode described with respect to FIGS. 4(*a*)–4(*f*).

Thus, once the valve spool moves past the shut off port, the stiff bias spring prevents it from moving much further. As shown in FIG. 10, at the normal port shutoff position (reference point 1), both the weaker spring and the stiffer spring have a force of just over 4 pounds, or about 3.5–4.5 psi pressure on the diaphragm. Thus, the positive oil drive bias of U.S. Pat. No. 3,775,030 is maintained. Now, however, as travel is continued towards the maximum spring compression, the stiff spring has over 12 pounds of force versus only about 5 pounds of force for the weak spring. The added force limits the ability of the diaphragm to move too far under high vacuum conditions. This is true because the pull from the oil transfer chamber side is now the spring force plus the pressure differential between the pumping chamber and the transfer chamber. The conventional weak spring could only effectively counteract about 5 psi of vacuum; the improved stiff spring is optimized at counteracting about 10.5 psi of vacuum, which is all that is practically attainable (although theoretically, 14.7 psi could be obtained). Although designing for the highest force possible would assure that oil never is pushed into a full transfer chamber, it is only necessary that there is not a net increase in oil during a full suction and output cycle of the pump. In other words, as long as there is more time during the suction and output strokes where the hydraulic transfer chamber is above atmospheric pressure than below, there will be no average increase of oil in the chamber.

Vacuum diaphragm rupture testing was done. Test results are shown in Table 1. A pump as described in FIG. 2 was used modified to have stiffer spring constants for bias spring 126 as shown in Table 1. A vacuum was maintained at the inlet (check valve 36). The vacuum was maintained at 15 in. Hg or less for a few hours and then was increased to 20 in. Hg or greater until failure or until the test was stopped.

TABLE 1

| Test | Ser. No. | R | Run Time | Outcome |
|---|---|---|---|---|
| 1 | 141849 | 43.1 lb/in | 97 hr | Rupture |
| 2 | 141849 | 43.1 | 55 | Rupture |
| Comment: Burr found; valve housing interior deburred | | | | |
| 3 | 141849 | 43.1 | 106 | Rupture |
| 4 | 142132 | 53.7 | 106 | OK |
| 5 | ? | 53.7 | 124 | OK |
| 6 | 142131 | 53.7 | 214 | OK |

The first three tests were run with a stiff spring having a spring constant of 43.1 lb/in. The diaphragm ruptured at 97 hr. during the first test and at 55 hr. during the second test. After the second test, the pump was examined and a burr was found in the valve housing so that valve spool 84 was sticking so that eventually the diaphragm ballooned and got caught on base plate 90. The valve housing was deburred and test 3 was run. The diaphragm ruptured at 106 hr. It was determined that the burr was not material to the findings except for time to failure. The 43.1 lb/in rated spring allowed failure to occur at about 100 hours.

Tests 4–6 were run using a bias spring having a spring constant of 53.7 lb/in. In each test, the pump ran for over 100 hr. and for Test 6, the pump ran for over 200 hr. without diaphragm rupture.

Figure 11:
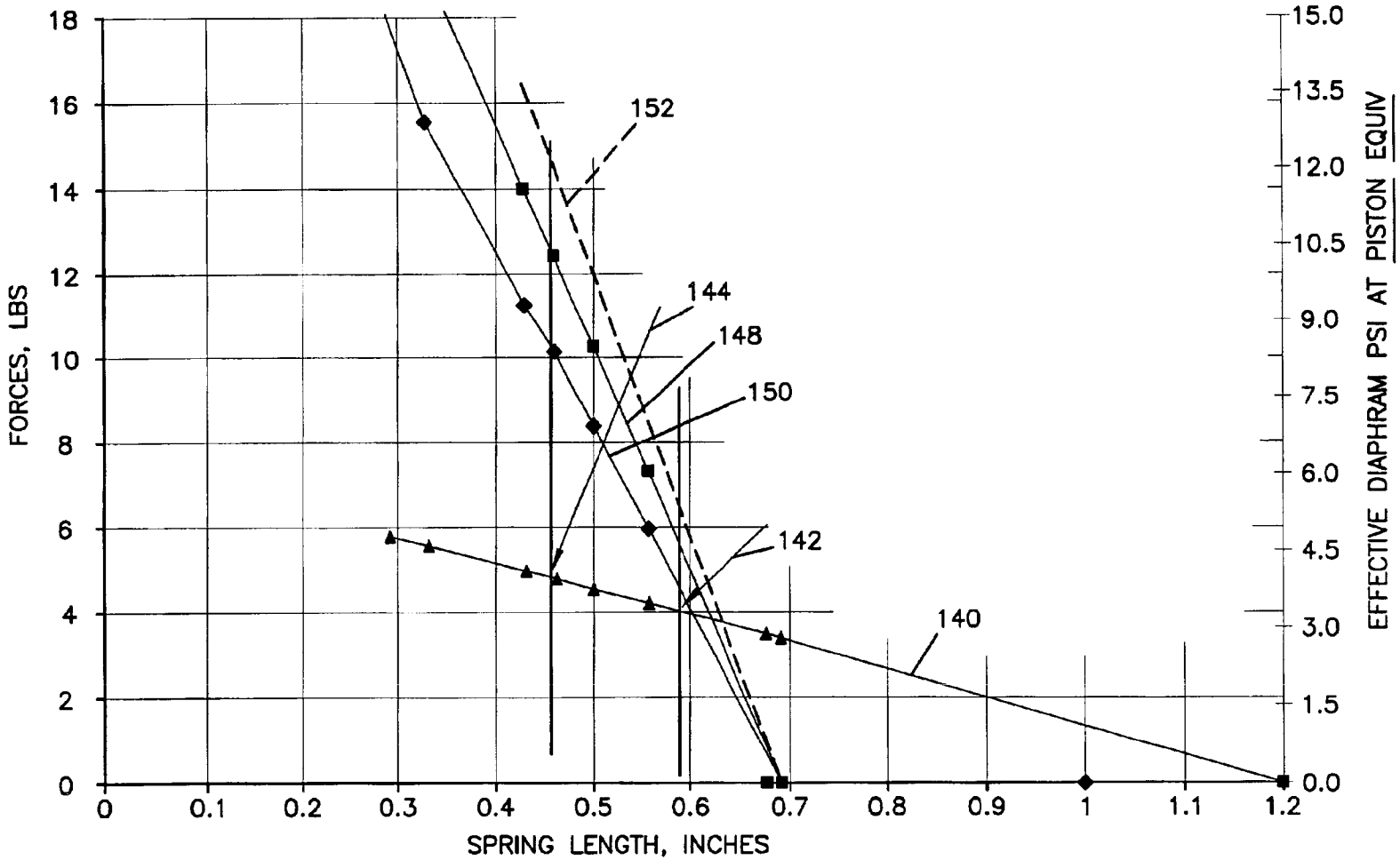
FIG. 11 is a graph which illustrates a range of spring constants for bias springs in accordance with the present invention.
Figure 12A:
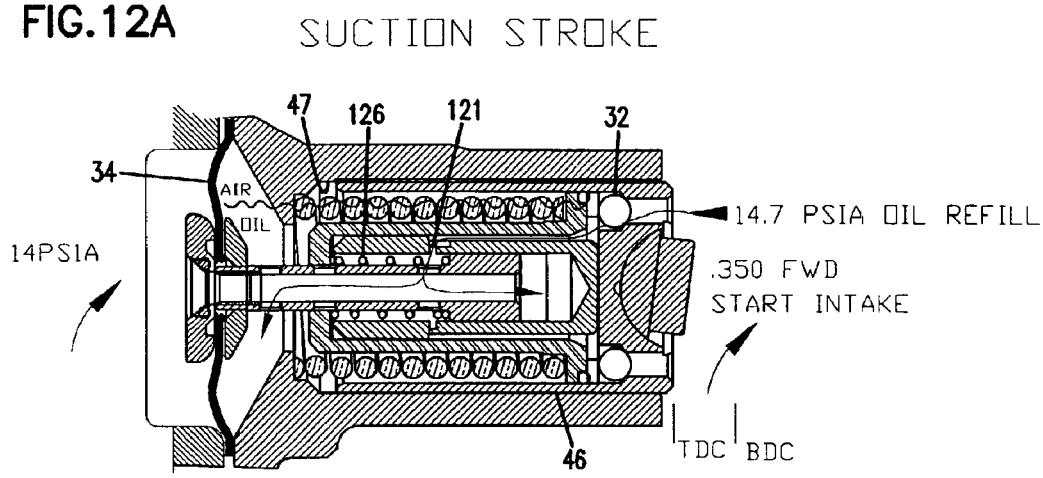
FIGS. 12(*a*)–12(*f*) are partial cross-sectional views of a diaphragm pump having an air-expelling notch and illustrating self-priming.
Figure 12B:
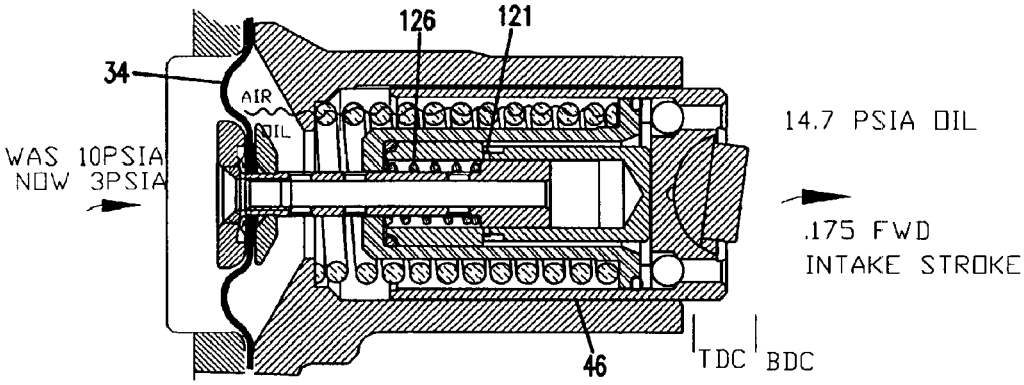
Figure 12C:
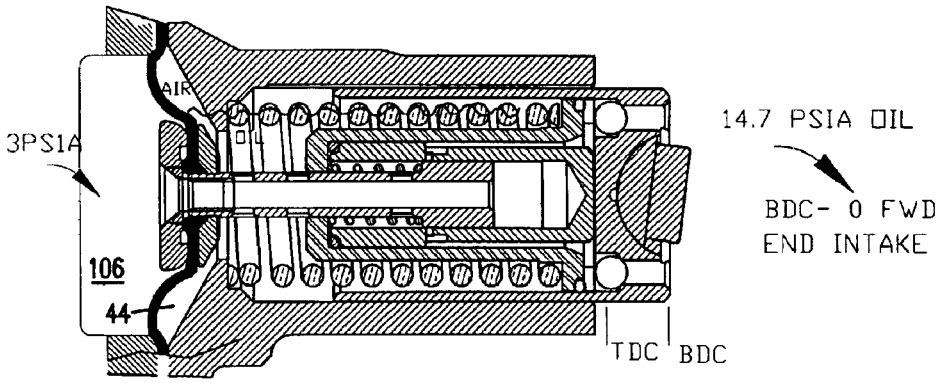
Figure 12D:
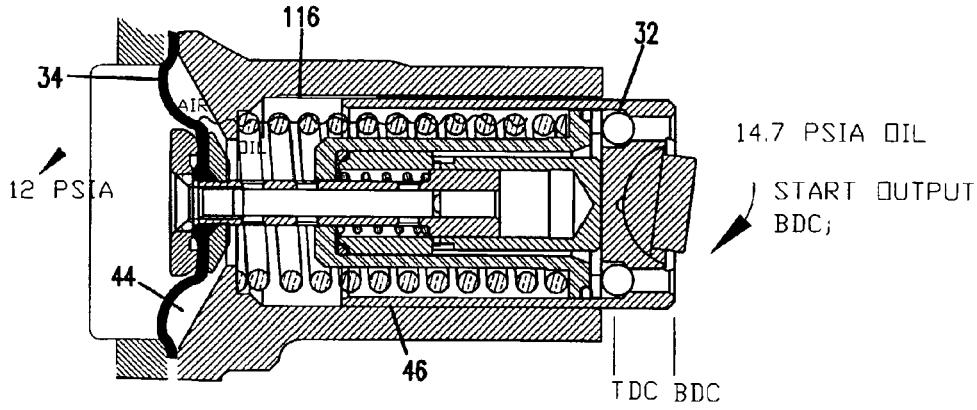
Figure 12E:
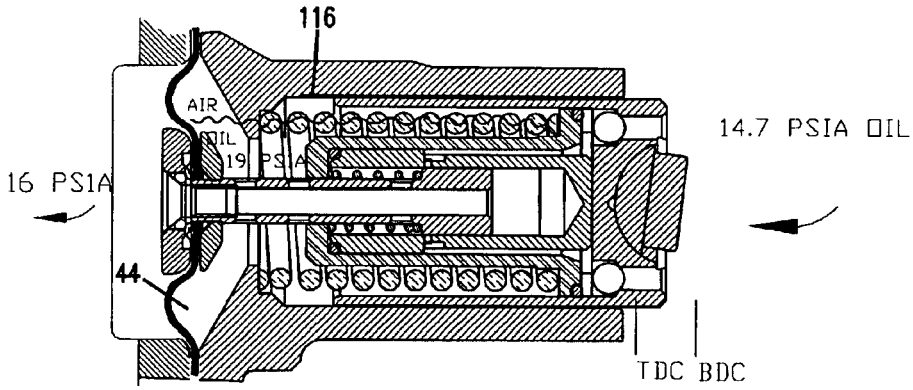
Figure 12F:
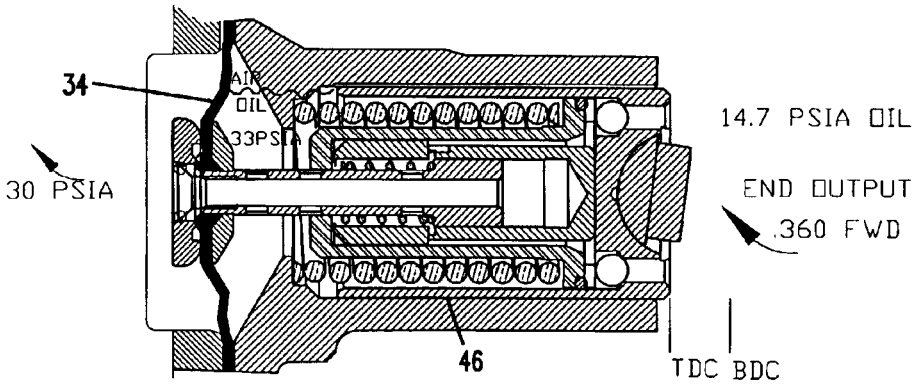

It was determined from the testing that the bias spring having the spring constant of 43.1 lb/in. was marginally acceptable. Clearly the pump having the bias spring with spring constant 53.7 lb/in. was acceptable since there were no failures. The conclusions of the testing are shown in FIG. 11. Line 150 shows the bias spring having spring constant of 43.1 lb/in. Line 148 shows the bias spring having spring constant of 53.7 lb/in. Broken line 152 represents a bias spring having a spring constant which would be the maximum ever needed. That is, the maximum vacuum which could be achieved at reference point 2, the point at which base plate 88 contacts wall 108 (see FIG. 4(*e*)) is 14.7 psia. A pump like this could never achieve such a vacuum.

Therefore, line 152 is shown as being broken and somewhat approximate. In any case, it gives the general idea of where a maximum spring constant would be.

For a particular pump, the spring constant can be calculated in the following way assuming the following design assumptions. First, the diaphragm's equivalent area at mid-stroke is approximately the same as the piston area. Second, the minimum pressure differential across the diaphragm needed must be equal to the suction pressure the pump is designed for. Third, the maximum pressure differential is 14.7 psi. Based on that, the following statements can be made:

1. Overfill distance is the difference in distance between the diaphragm and the piston at (i) maximum overfill position and (ii) neutral position (valve just closed).
2. Overfill spring force is design suction pressure differential times the piston area.
3. Neutral spring force is the neutral operating pressure differential times the piston area.
4. Spring constant is the quantity of overfill spring force minus neutral spring force divided by the overfill distance.

Based on these assumptions and statements, spring constant can be calculated from:

$$k=A_p(P_s-P_n)/d_0$$

where k is spring constant, $A_p$ is piston area, $d_0$ is overfill distance, $P_s$ is design suction pressure differential, $P_n$ is neutral operating pressure differential.

Based on the testing discussed above, appropriate maximum design suction pressure differential is 8.4–14.7 psia. Appropriate neutral operating pressure differential is zero to 4 psia.

It is noted from FIGS. 10 and 11 that the stiffer bias spring of the present invention is necessarily shorter than the conventional spring. This has a good benefit in that when the pump is shut-down, the bias spring does not continually force oil out of the transfer chamber and past the piston assembly/housing interface to the reservoir. With the stiffer spring, once the transfer chamber has properly filled and the pump is turned-off, the spring no longer exerts a significant force. That means the transfer chamber has an oil fill which is at its proper pumping point, and it does not have to refill at the next start-up. On the other hand, the shorter spring does create a negative. The shorter spring does not fully expel air from the transfer chamber prior to initial start-up. The added air makes it very difficult to fully prime the transfer chamber 44. In this case, the pump must be taken apart and manually primed or vacuum-primed for each of the several transfer chambers. Furthermore, sometimes the pump loses prime under conditions where air in the oil can accumulate and not be expelled. To address these negatives, notch 116 was developed. Notch 116 is a mechanism for expelling air. FIGS. 12(*a*)–12(*f*) show the operation of a pump having notch 116 with respect to bleeding air off and providing the further benefit of allowing the pump to self-prime.

In FIG. 12(*a*), the suction stroke begins. Transfer chamber 44 has an excess of air. Oil flows through open valve port 98 and pushes air to the high point in cylinder 47. As the suction stroke starts, more oil wants to enter through check valves 32 and valve port 98, but stiff bias spring 126 holds diaphragm 32 to move along with piston 46.

At mid-stroke as shown in FIG. 12(*b*), there is a higher suction so that diaphragm 32 is pulled to the left to shut off valve port 121. The stiff bias spring 126 resists compressing excessively so that diaphragm 32 moves substantially with piston 46.

As shown in FIG. 12(*c*), there is still a high suction in the pumping chamber 106 as piston 46 nears its end stroke (BDC). The stiff spring limits the diaphragm plunger 42 and diaphragm 34 from going too far left and raises the pressure in the transfer chamber 44 to prevent oil overfill.

As the output stroke begins as shown in FIG. 12(*d*), piston 46 starts moving to the left, while check valves 32 close, and pressure in transfer chamber 44 builds. The rising pressure in transfer chamber 44 pushes air out notch 116.

At mid-stroke as in FIG. 12(*e*), pressure in transfer chamber 44 is above the reservoir pressure, and air continues to be pushed through notch 116.

At the end of the output stroke as in FIG. 12(*f*), diaphragm 34 moves left as piston 46 moves left. Most of the air in transfer chamber 44 has now been expelled. As subsequent suction and output strokes proceed, all of the air gets expelled and the pump rapidly self-primes itself.

Notch 116 can be square, hemispherical, triangular, or any shape. Notch 116 must be large enough to allow air to rather rapidly bleed off, but not so large that pump efficiency will suffer. Generally, a 1% loss of pump efficiency is acceptable. For a particular pump, it is then necessary to calculate an equivalent cross-sectional area for notch 116 which would be equivalent to the 1% loss of efficiency.

As indicated earlier, the notch 116 should be placed at the top of the cylinder 120 so that it is located at the point where air would collect. The notch 116 should be long enough so that it is exposed to the pressurized oil zone for at least part of the piston stroke. It may extend to the end of the piston travel so that it is exposed for the entire stroke. The best practice is to have it exposed for the first half of the stroke only. The notch size must be large enough to allow rapid passage of air, and small enough to resist oil passage so that pump performance is not significantly reduced.

For most pumps the cross sectional area of the notch 116 should be about 0.0002 square inches and height of 0.017 inches. To purge air effectively the cross sectional area should be greater than 0.00005 square inches. The maximum cross sectional area would be about 0.003 square inches. The height and width of the groove cross-section should both be greater than 0.005 inches.

The improved pump of the present invention results in improved reliability because premature diaphragm ruptures caused by unintended hydraulic oil over-fill of the transfer chamber is eliminated. The improved pump results in improved efficiency and smoothness of output because the fully intended diaphragm stroke length is continually utilized because there is less air left in the transfer chamber during normal operation. The pump of the present invention has an improved metering capability of oil/air relative to the transfer chamber and reservoir thereby ensuring a consistently high quality of oil within the transfer chamber and thereby maintaining the "stiffest" hydraulic system practical, regardless of pump inlet and outlet conditions. The pump of the present invention self-primes and avoids any loss of prime during operation. Thus, the pump of the present invention is significantly improved over the conventional diaphragm pump.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A diaphragm pump for receiving drive power from a motor, said pump comprising:

a housing having a pumping chamber adapted to contain fluid to be pumped, a transfer chamber adapted to contain hydraulic fluid, and a hydraulic fluid reservoir;

a diaphragm having a transfer chamber side and a pumping chamber side, said diaphragm being disposed between said pumping chamber and said transfer chamber and adapted for reciprocation toward and away from said pumping chamber;

a piston in a cylinder in said housing adapted for reciprocation between a power stroke and a suction stroke, said cylinder forming a portion of said transfer chamber, said piston moving longitudinally in said cylinder with said cylinder having a surface with an upper portion when said pump is oriented so that said cylinder is generally horizontal;

a fluid communication path for the hydraulic fluid between said hydraulic fluid reservoir and said transfer chamber and a valve in said path for selectively allowing flow of hydraulic fluid from said hydraulic fluid reservoir to said transfer chamber when said valve is open; and a vent between said transfer chamber and said hydraulic fluid reservoir formed in the upper portion of the surface of said cylinder, said vent include a longitudinal notch in the upper portion of the surface of the said cylinder, said vent being without access external to said housing;

wherein air in said transfer chamber is forced therefrom through said vein in said cylinder to enhance the quality of the fluid in the transfer chamber and to sell prime said pump.

2. The diaphragm pump of claim 1 including a spring urging said diaphragm away from said pumping chamber with a first end of said spring connected with said diaphragm and a second end of said spring supported by said piston for movement therewith, said spring having a spring constant obtained from $$k=A_p(P_s-P_n)/d_0$$

where $A_p$=piston area, $d_0$=overfill distance, $P_s$=pump design suction pressure, $P_n$=pump neutral operating pressure, and where design suction pressure ranges from 8.4 to 14.7 psia and neutral operating pressure ranges from zero to 4 psia.

3. The diaphragm pump of claim 1 wherein said notch ends before opening to said hydraulic fluid reservoir, said housing having a passage extending therethrough from said notch to said reservoir, said passage including a check valve.

4. The diaphragm pump of claim 1 wherein said check valve is formed by an O-ring groove and an O-ring in said groove, said passage ending in said groove on a side of said housing opposite said notch.

5. The diaphragm pump of claim 1 wherein said piston has an end and said notch ends before reaching the end of that piston when the piston fully completes the power stroke.

6. The diaphragm pump of claim 1 wherein the notch has a cross-sectional area greater than 0.00005 square inches and less than 0.003 square inches.

7. The diaphragm pump of claim 5 wherein the notch has a height width both greater than 0.005 inches.

8. The diaphragm pump of claim 1 wherein said cylinder has a wall as a part of said housing and wherein said vent is a passage through said wall providing fluid communication from the upper portion of the surface of said cylinder to said hydraulic fluid reservoir.

9. The diaphragm pump of claim 8 wherein the passage has a cross-sectional area greater than 0.00005 square inches and less than 0.003 square inches.

10. The diaphragm pump of claim 9 wherein the passage has a diameter greater than 0.005 inches.

11. A diaphragm pump for receiving drive power from a motor, said pump comprising:

a housing having a pumping chamber adapted to contain fluid to be pumped, a transfer chamber adapted to contain hydraulic fluid, and a hydraulic fluid reservoir;

a diaphragm having a transfer chamber side and a pumping chamber side, said diaphragm being supported by said casing and-disposed between said pumping chamber and said transfer chamber and adapted for reciprocation toward and away from said pumping chamber;

a piston in a cylinder in said housing adapted for reciprocation between a power stroke and a suction stroke, said cylinder forming a portion of said transfer chamber, said piston moving longitudinally in said cylinder with said cylinder having a surface; and a fluid communication path for the hydraulic fluid between said hydraulic fluid reservoir and said transfer chamber and a valve in said path for selectively allowing flow of hydraulic fluid from said hydraulic fluid reservoir to said transfer chamber when said valve is open; said valve having a valve port in the surface of said cylinder, the surface of said cylinder including circumferential groove intersecting said valve port wherein said groove allows said piston to move more smoothly past said valve port.

* * * * *

UNITED STATES PATENT AND TRADEMARK OFFICE

CERTIFICATE OF CORRECTION

PATENT NO. : 6,899,530 B2
APPLICATION NO. : 10/285968
DATED : May 31, 2005
INVENTOR(S) : Lehrke et al.

It is certified that error appears in the above-identified patent and that said Letters Patent is hereby corrected as shown below:

Col. 13 lines 1-35, should read,

1. A diaphragm pump for receiving drive power from a motor, said pump comprising:

a housing having a pumping chamber adapted to contain fluid to be pumped, a transfer chamber adapted to contain hydraulic fluid, and a hydraulic fluid reservoir;

a diaphragm having a transfer chamber side and a pumping chamber side, said diaphragm being disposed between said pumping chamber and said transfer chamber and adapted for reciprocation toward and away from said pumping chamber;

a piston in a cylinder in said housing adapted for reciprocation between a power stroke and a suction stroke, said cylinder forming a portion of said transfer chamber, said piston moving longitudinally in said cylinder with said cylinder having a surface with an upper portion when said pump is oriented so that said cylinder is generally horizontal;

a fluid communication path for the hydraulic fluid between said hydraulic fluid reservoir and said transfer chamber and a valve in said path for selectively allowing flow of hydraulic fluid from said hydraulic fluid reservoir to said transfer chamber when said valve is open; and a vent between said transfer chamber and said hydraulic fluid reservoir formed in the upper portion of the surface of said cylinder, said vent ~~include~~ <u>including</u> a longitudinal notch in the upper portion of the surface of ~~the~~ said cylinder, said vent being without access external to said housing;

UNITED STATES PATENT AND TRADEMARK OFFICE

CERTIFICATE OF CORRECTION

PATENT NO. : 6,899,530 B2
APPLICATION NO. : 10/285968
DATED : May 31, 2005
INVENTOR(S) : Lehrke et al.

It is certified that error appears in the above-identified patent and that said Letters Patent is hereby corrected as shown below:

wherein air in said transfer chamber is forced therefrom through said vein in said cylinder to enhance the quality of the fluid in the transfer chamber and to sell prime said pump.

Signed and Sealed this

Twenty-second Day of December, 2009

David J. Kappos

David J. Kappos
*Director of the United States Patent and Trademark Office*